US008440896B2

(12) United States Patent
Hoshino

(10) Patent No.: US 8,440,896 B2
(45) Date of Patent: May 14, 2013

(54) KEYBOARD DEVICE

(75) Inventor: Akihisa Hoshino, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 28 days.

(21) Appl. No.: 13/285,124

(22) Filed: Oct. 31, 2011

(65) Prior Publication Data

US 2012/0103165 A1 May 3, 2012

(30) Foreign Application Priority Data

Nov. 1, 2010 (JP) ..... 2010-244895
Aug. 22, 2011 (JP) ..... 2011-180269

(51) Int. Cl.
*G10C 3/12* (2006.01)

(52) U.S. Cl.
USPC ..... 84/433; 84/423 R

(58) Field of Classification Search ..... 84/433, 84/423 R
See application file for complete search history.

(56) References Cited

U.S. PATENT DOCUMENTS 4,914,999 A * 4/1990 Masubuchi et al. ..... 84/423 R
5,131,308 A * 7/1992 Katsuta ..... 84/434
5,929,357 A * 7/1999 Masubuchi ..... 84/423 R
5,955,690 A * 9/1999 Yoshinaga ..... 84/437
6,002,078 A * 12/1999 Yoshinaga et al. ..... 84/436
6,051,768 A * 4/2000 Masubuchi ..... 84/433
6,087,576 A * 7/2000 Masubuchi ..... 84/433
6,156,963 A * 12/2000 Masubuchi et al. ..... 84/423 R
6,369,309 B1 * 4/2002 Nishida ..... 84/423 R
7,297,855 B2 * 11/2007 Nishida ..... 84/423 R
7,365,259 B2 * 4/2008 Nishida ..... 84/423 R
7,465,863 B2 * 12/2008 Nishida ..... 84/423 R
7,476,795 B2 * 1/2009 Toyama ..... 84/433
7,485,798 B2 * 2/2009 Nishida ..... 84/644
7,544,876 B2 * 6/2009 Toyama ..... 84/433
8,003,871 B2 * 8/2011 Kitajima ..... 84/423 R
8,119,895 B2 * 2/2012 Kitajima ..... 84/423 R
2012/0103165 A1 * 5/2012 Hoshino ..... 84/433

FOREIGN PATENT DOCUMENTS

JP 05-011747 A 1/1993

* cited by examiner

*Primary Examiner* — David Warren
*Assistant Examiner* — Robert W Horn
(74) *Attorney, Agent, or Firm* — Holtz, Holtz, Goodman & Chick, P.C.

(57) ABSTRACT

This key structure includes rotating shaft sections 12, 16, and 20 which are respectively provided in the rear end of key bodies 11, 15, and 19 arrayed in parallel, and serve as rotation fulcrums for rotations of the key bodies 11, 15, and 16 in an up and down direction, and connecting sections 14, 18, and 22 which respectively rotatably connect the rotating shaft sections 12, 16, and 20 along a key array direction. Therefore, the key bodies 11, 15, and 19 can be integrally formed by the connecting sections 14, 18, and 22, and the rotating shaft sections 12, 16, and 20 can be independently rotated. Additionally, as a result of the rotating shaft sections 12, 16, and 20 being evenly arrayed, the spacing between the keys and the key alignment can beheld evenly, and the key bodies 11, 15, and 19 can be stably rotated when depressed.

9 Claims, 22 Drawing Sheets

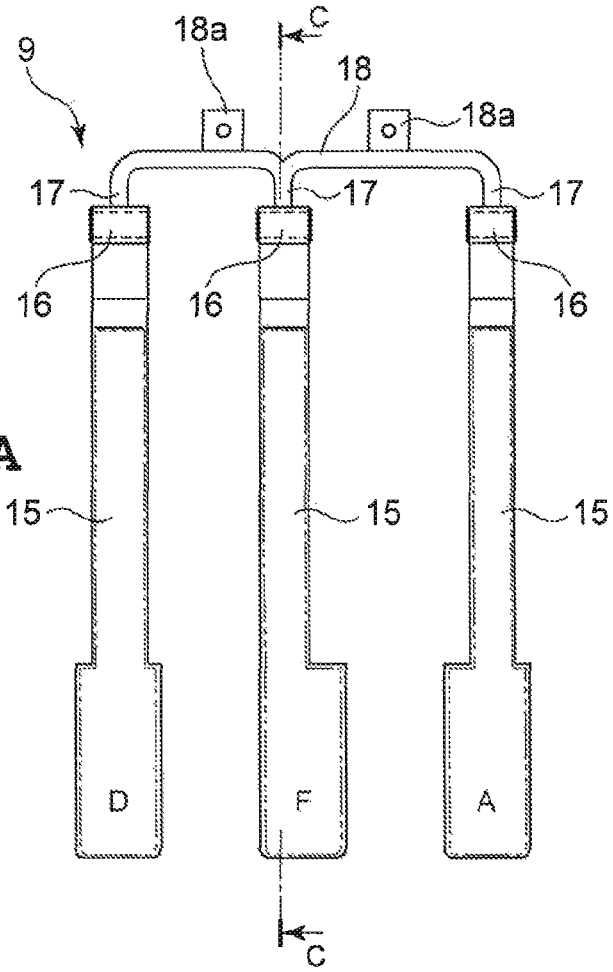
FIG. 5A
FIG. 5B
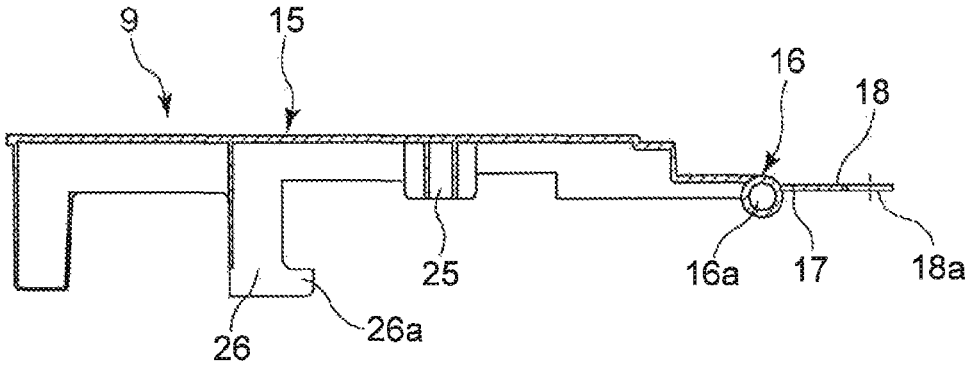

KEYBOARD DEVICE

CROSS-REFERENCE TO RELATED APPLICATIONS

This application is based upon and claims the benefit of priority from the prior Japanese Patent Applications No. 2010-244895, filed Nov. 1, 2010 and No. 2011-180269, filed Aug. 22, 2011, the entire contents of which are incorporated herein by reference.

BACKGROUND OF THE INVENTION

1. Field of the Invention

The present invention relates to a key structure and a keyboard device used in a keyboard instrument, such as an electronic piano or an electronic organ.

2. Description of the Related Art

Conventionally, a keyboard device of an electronic piano is known in which a plurality of keys are integrally formed for the purpose of mounting the plurality of keys to a keyboard chassis all together, a thin bendable section that bends in an up and down direction is formed in a rear end portion of each key, and the bendable sections are successively connected to a connecting section which follows the array direction of the keys, as described in Japanese Patent Application Laid-Open (Kokai) Publication No. 05-011747.

However, in the conventional keyboard device such as that described above, the bendable sections are thin. Therefore, spacing between adjacent keys and key alignment may become uneven depending on the formation accuracy when the keys are integrally formed. In addition, the bendable sections, which serve as the rotation fulcrum of the keys, may cause an unstable bending movement when a key depression operation is performed.

For example, the bendable sections may tilt in the array direction of the keys when a key depression operation is performed and the bendable section bends in the up and down direction. In such cases, the key makes a so-called rolling movement in which a key rotates in an up and down direction while being tilted in its array direction.

Therefore, in a conventional keyboard device such as that described above, a key guide section which guides a key in an up and down direction is required to be provided in the keyboard chassis to prevent spacing between the keys and the key alignment from becoming uneven depending on the formation accuracy when the keys are integrally formed, and to prevent an unstable movement such as the rolling movement of a key when it is depressed. However, there is a problem in that providing a key guide section such as this increases the number of its components, and complicates the structure, whereby the assembly operation becomes complicated and the manufacturing cost increases.

SUMMARY OF THE INVENTION

The present invention has been conceived to solve the above-described problem, and an object of the present invention is to provide a key structure and a keyboard device capable of maintaining evenness in spacing between keys and key alignment, and which favorably and stably rotates a key in an up and down direction without using a key guide.

In accordance with one aspect of the present invention, there is provided a key structure comprising: a plurality of key bodies which are arrayed in parallel; a plurality of rotating shaft sections which are respectively provided in rear end portions of the plurality of key bodies and serve as fulcrums for rotations of the plurality of key bodies in an up and down direction; and a connecting section which rotatably connects the plurality of rotating shaft sections along an array direction of the key bodies.

In accordance with another aspect of the present invention, there is provided a keyboard instrument comprising: a keyboard chassis; a plurality of key bodies which are arrayed in parallel on the keyboard chassis; a plurality of rotating shaft sections which are respectively provided in rear end portions of the plurality of key bodies and serve as fulcrums for rotations of the plurality of key bodies in an up and down direction; a connecting section which connects the plurality of rotating shaft sections along an array direction of the key bodies by bendable sections which are bendable in the up and down direction; and a key supporting section which is provided on the keyboard chassis and holds the plurality of rotating shaft sections so as to be rotatable in the up and down direction.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIG. 5A is an enlarged planar view of a second white key unit in the keyboard section shown in FIG. 2;

FIG. 5B is an enlarged cross-sectional view of the second white key unit taken along line C-C in FIG. 5A;

DETAILED DESCRIPTION OF THE PREFERRED EMBODIMENTS

First Embodiment

A first embodiment in which the present invention has been applied to a keyboard instrument will hereinafter be described with reference to FIG. 1 to FIG. 9.

Figure 1:
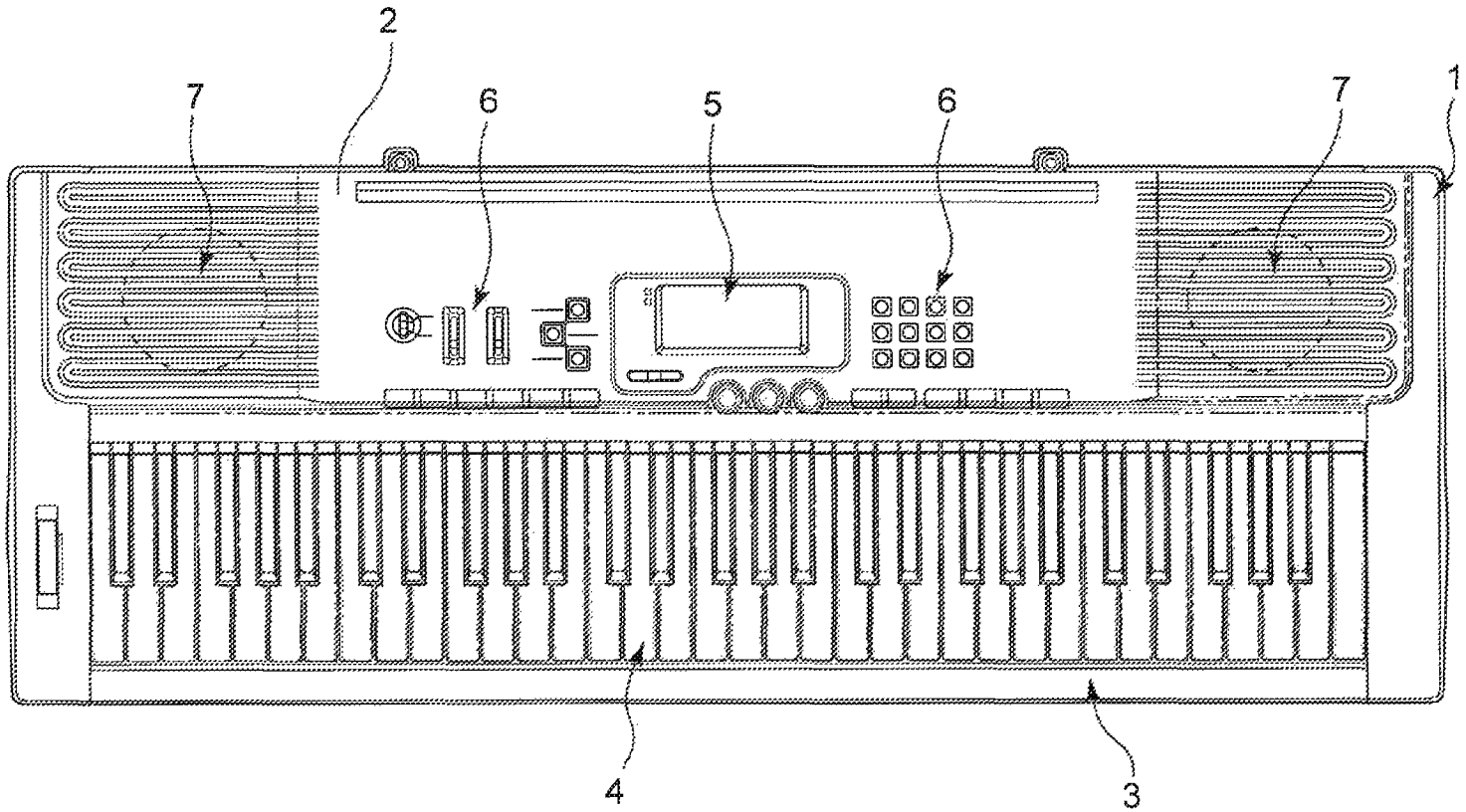
FIG. 1 is a planar view of a first embodiment in which the present invention has been applied to a keyboard instrument.
Figure 2:
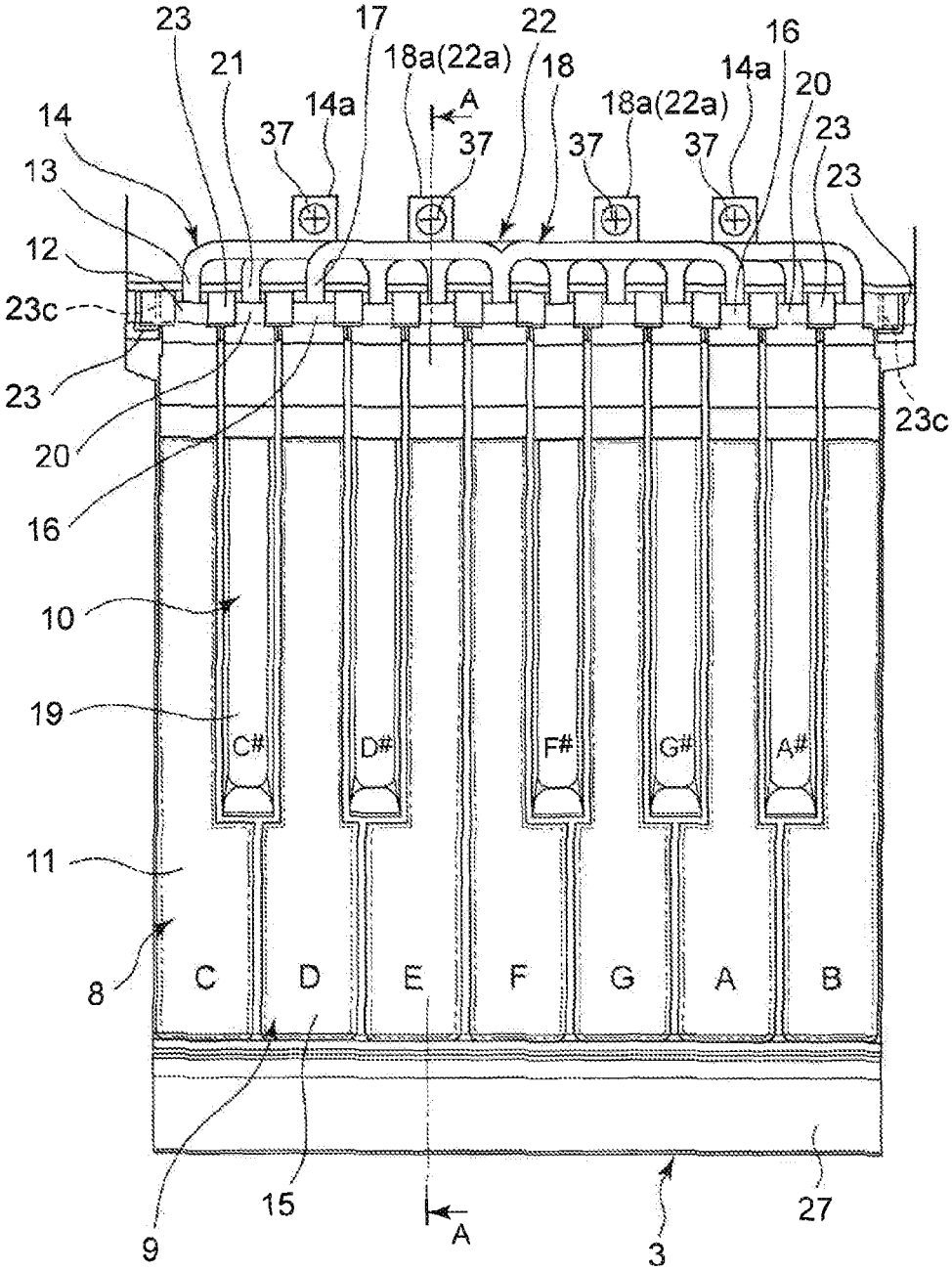
FIG. 2 is an enlarged planar view showing the main portion of the keyboard section of the keyboard instrument shown in FIG. 1.
Figure 3:
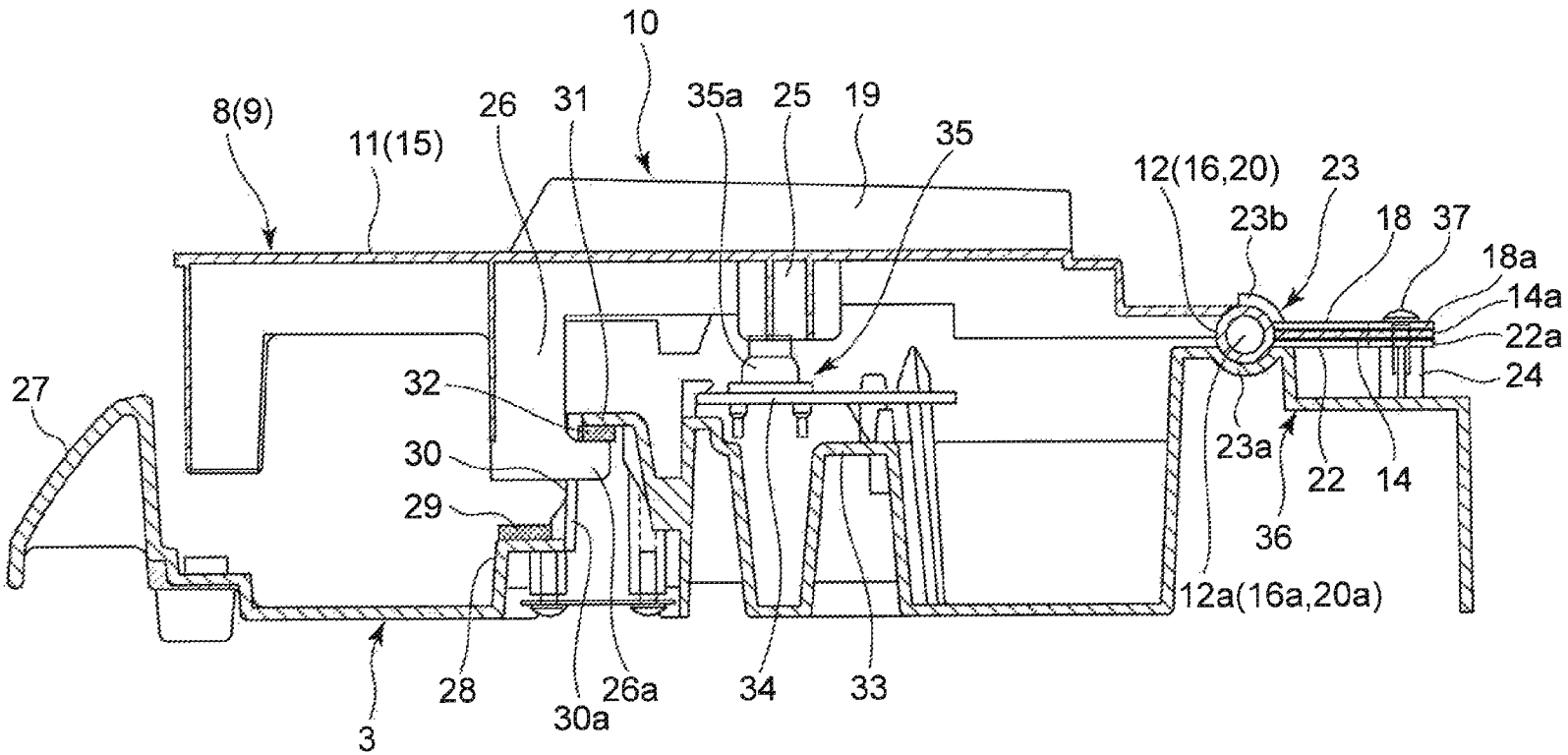
FIG. 3 is an enlarged cross-sectional view of the keyboard section taken along line A-A in FIG. 2.

This keyboard instrument includes an instrument body 1 formed into a box shape that is elongated in a left-right direction, as shown in FIG. 1. The instrument body 1 includes an upper case 2 and a keyboard chassis 3 that serves as a lower case, and a keyboard section 4 exposing upward is provided in this instrument body 1, as shown in FIG. 1 to FIG. 3.

As shown in FIG. 1, a display section 5 including a flat display panel, such as a liquid crystal display panel or an electroluminescent (EL) display panel, is provided in the center portion of the upper case 2, and various operating switches 6 for volume adjustment and tone selection are provided on the top surface of the upper case 2 so as to be positioned on both sides of the display section 5. In addition, a speaker section 7 for producing a musical sound is provided on the left side and the right side of the upper case 20.

Figure 4A:
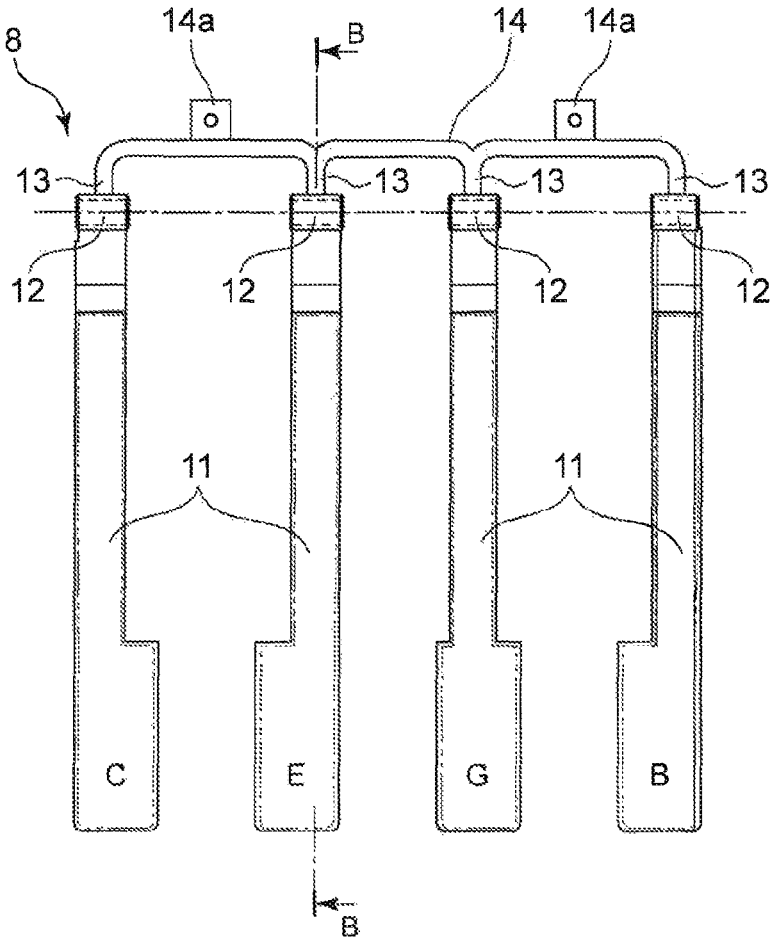
FIG. 4A is an enlarged planar view of a first white key unit in the keyboard section shown in FIG. 2.

The keyboard section 4 includes a first white key unit 8, a second white key unit 9, and a black key unit 10, as shown in FIG. 2, and FIG. 4A to FIG. 6B. The first white key unit 8 is structured such that a rotating shaft section 12 is provided in the rear end portion (right end portion in FIG. 4B) of each of plural key bodies 11 (C, E, G, and B keys), and each rotating shaft section 12 is connected to a connecting section 14 by a bendable section 13 that bends in an up and down direction, as shown in FIG. 4A and FIG. 4B.

The second white key unit 9 is structured such that a rotating shaft section 16 is provided in the rear end portion (right end portion in FIG. 5B) of each of plural key bodies 15 (D, F, and A keys), and each rotating shaft section 16 is connected to a connecting section 18 by a bendable section 17 that bends in the up and down direction, as shown in FIG. 5A and FIG. 5B.

Figure 6A:
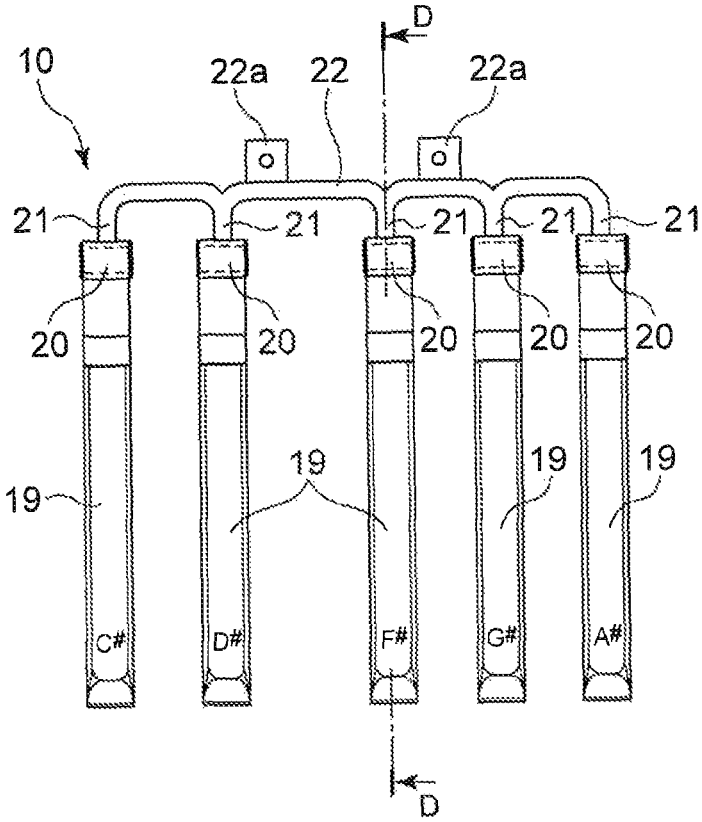
FIG. 6A is an enlarged planar view of a black key unit in the keyboard section shown in FIG. 2.
Figure 6B:
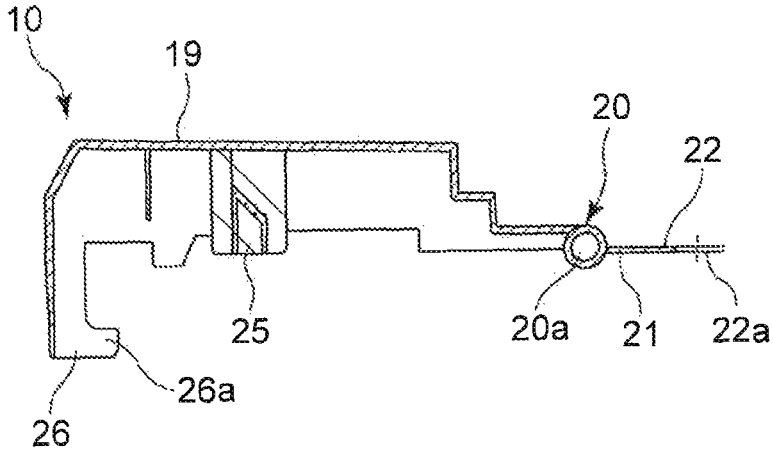
FIG. 6B is an enlarged cross-sectional view of the black key unit taken along line D-D in FIG. 6A.

The black key unit 10 is structured such that a rotating shaft section 20 is provided in the rear end portion (right end portion in FIG. 6B) of each of plural key bodies 19 (C#, D#, F#, G#, and A# keys), and each rotating shaft section 20 is connected to a connecting section 22 by a bendable section 21 that bends in the up and down direction, as shown FIG. 6A and FIG. 6B.

In this instance, the rotating shaft sections 12, 16, and 20 of the first white key unit 8, the second white key unit 9, and the black key unit 10 respectively serve as rotation fulcrums of the key bodies 11, 15, and 19, and the axial centers of the rotating shaft sections 12, 16, and 20 are consecutively and coaxially formed along the array direction of the key bodies 11, 15, and 19 (hereinafter, referred to as a key array direction). In addition, shaft holes 12*a*, 16*a*, and 20*a* passing through along the key array direction are respectively provided in the rotating shaft sections 12, 16, and 20, which prevent sink marks of a molding resin when injection-molding is performed using a mold for molding.

As a result, the keyboard section 4 is structured such that the respective key bodies 11, 15, and 19 of the first white key unit 8, the second white key unit 9, and the black key unit 10 are arrayed in parallel on the keyboard chassis 3, the rotating shaft sections 12, 16, and 20 are attached to a plurality of later-described bearing sections 23 on the keyboard chassis 3 so as to be rotatable in the up and down direction, and the connecting sections 14, 18, and 22 are attached to later-described attachment bosses 24 provided on the keyboard chassis 3, as shown in FIG. 2 and FIG. 3.

In this instance, the first white key unit 8 and the second white key unit 9 are formed such that the sizes and the positions of the key bodies 11 and 15 are the same, and the sizes and the positions of the rotating shaft sections 12 and 16 are the same, as shown in FIG. 4A to FIG. 5B. In addition, they are formed such that rigidity from the front ends (left ends in FIG. 4B and FIG. 5B) of the key bodies 11 and 15 to the rotating shaft sections 12 and 16 is high, as shown in FIG. 4B and FIG. 5B.

Figure 4B:
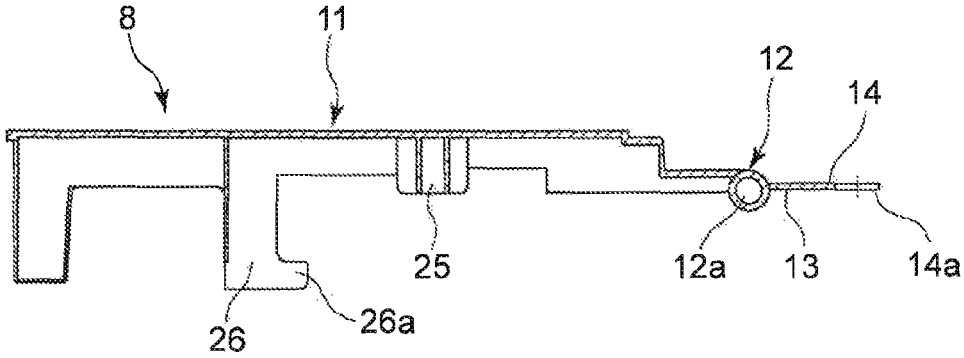
FIG. 4B is an enlarged cross-sectional view of the first white key unit taken along line B-B in FIG. 4A.

Also, each of these key bodies 11 and 15 of the first white key unit 8 and the second white key unit 9 has a switch pressing section 25 and a stopper hook section 26, as shown in FIG. 4B and FIG. 5B. The first white key unit 8 and the second white key unit 9 are structured such that the junction points of the connecting section 14 and the bendable sections 13 in relation to the rotating shaft sections 12 are different from the junction points of the connecting section 18 and the bendable sections 17 in relation to the rotating shaft sections 16.

That is, each bendable section 13 of the first white key unit 8 is located in an area corresponding to the rotational center of the rotating shaft section 12, in the rear of the outer peripheral surface of each rotating shaft section 12. Accordingly, the connecting section 14 of the first white key unit 8 is also provided in an area corresponding to the rotational center of the rotating shaft section 12. On this connecting section 14, attachment pieces 14*a* that are attached to the attachment bosses 24 on the keyboard chassis 3 are provided at a predetermined interval.

On the other hand, each bendable section 17 of the second white key unit 9 is provided in an area slightly above the rotational center of the rotating shaft section 16, in the rear of the outer peripheral surface of each rotating shaft section 16.

Accordingly, the connecting section 18 of the second white key unit 9 is also provided in an area slightly above the rotational center of the rotating shaft section 16. On this connecting section 18, attachment pieces 18*a* that are attached to the attachment bosses 24 on the keyboard chassis 3 are provided at an interval narrower than that of the attachment pieces 14*a* of the first white key unit 8.

The black key unit 10 is structured such that the key bodies 19 are shorter than the key bodies 11 and 15 of the first white key unit 8 and the second white key unit 9, and the height of the key bodies 19 is higher than that of the key bodies 11 and 15 of the first white key unit 8 and the second white key unit 9, as shown in FIG. 6A and FIG. 6B. As shown in FIG. 6B, the black key unit 10 is formed such that rigidity from the front ends (left ends in FIG. 6B) of the key bodies 19 to the rotating shaft sections 20 is high as in the above case.

Each key body 19 of the black key unit 10 has the switch pressing section 25 and the stopper hook section 26, as shown in FIG. 6B and as in the case of the key bodies 11 and 15 of the first white key unit 8 and the second white key unit 9. In addition, the rotating shaft sections 20 of the black key unit 10 are formed having the same size and in the same positions as the rotating shaft sections 12 and 16 of the first white key unit 8 and the second white key unit 9.

Each bendable section 21 of the black key unit 10 is provided in an area slightly below the rotational center of the rotating shaft section 20, in the rear of the outer peripheral surface of each rotating shaft section 20, as shown in FIG. 6A and FIG. 6B. Accordingly, the connecting section 22 of the black key unit 10 is provided in an area slightly below the rotational center of the rotating shaft section 20. On this connecting section 22, attachment pieces 14*a* that are attached to the attachment bosses 24 on the keyboard chassis 3 are provided at the same interval as that of the attachment pieces 14*a* of the second white key unit 9.

As shown in FIG. 2 and FIG. 3, the first white key unit 8, the second white key unit 9, and the black key unit 10 are structured such that each key body 11 of the first white key unit 8 is arranged between the key bodies 19 of the black key unit 10 from above, the connecting section 14 of the first white key unit 8 is layered on the connecting section 22 of the black key unit 10, each key body 15 of the second white key unit 9 is arranged between the key bodies 19 of the black key unit 10 and the key bodies 11 of the first key unit 8 from above, and the connecting section 18 of the second white key unit 9 is layered on the connecting section 14 of the first white key unit 8. As a result, the key bodies 11, 15, and 19 are arrayed in the order of a musical scale.

In this instance, among the attachment pieces 14*a*, 18*a*, and 22*a* respectively provided on the connecting sections 14, 18, and 22 of the first white key unit 8, the second white key unit 9, and the black key unit 10, the attachment pieces 18*a* of the second white key unit 9 and the attachment pieces 22*a* of the black key unit 10 are provided at the same interval and overlap each other, as shown in FIG. 2. The attachment pieces 14*a* of the first white key unit 8 are provided at a wider interval than that of the attachment pieces 18*a* and 22*a* of the second white key unit 9 and the black key unit 10.

Figure 7:
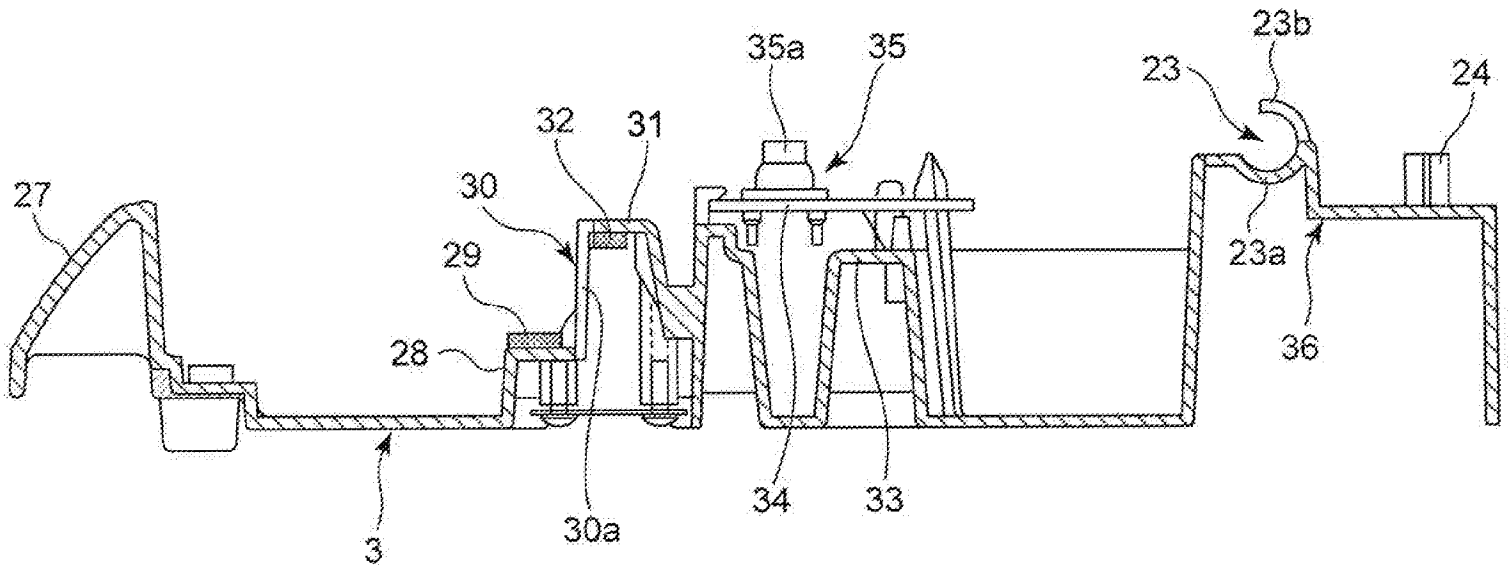
FIG. 7 is an enlarged cross-sectional view of the keyboard chassis of the keyboard section shown in FIG. 3.

On the other hand, in the structure of the keyboard chassis 3, a key cover section 27 that covers the front end surfaces of the key bodies 11 and 15 of the first white key unit 8 and the second white key unit 9 is provided in the front end portion (left end portion in FIG. 3) so as to project upwards, as shown in FIG. 3 and FIG. 7. In addition, a lower limit stopper mounting section 28 projecting slightly upwards from the bottom of the keyboard chassis 3 is provided in the front of the middle area of the keyboard chassis 3, and a lower limit stopper section 29 that restricts the lower limit positions of key bodies 11, 15, and 19 by the respective stopper hook sections 26 of the key bodies 11, 15, and 19 coming into contact with the lower limit stopper section 29 from above is provided on the lower limit stopper mounting section 28.

Moreover, a rising section 30 is provided in rear (to the right in FIG. 3) of the lower limit stopper mounting section 28 of the keyboard chassis 3 so as to be at a height almost the same as that of the key cover section 27, as shown in FIG. 3 and FIG. 7. The rising section 30 is provided with opening sections 30*a*, and a projecting section 26*a* projecting towards the rear (right side in FIG. 3) from the stopper hook section 26 of each key body 11, 15, and 19 is inserted into each opening section 30*a* so as to be movable in the up and down direction.

Furthermore, an upper limit stopper mounting section 31 is provided in the upper portion of the rising section 30, which is located at a height almost the same as that of the key cover section 27, as shown in FIG. 3 and FIG. 7. In addition, an upper limit stopper section 32 that restricts the upper limit position of key bodies 11, 15, and 19 by the projecting sections 26*a* projecting towards the rear from the stopper hook sections 26 coming into contact with the upper limit stopper section 32 from below is provided on the undersurface of the upper limit stopper mounding section 31.

Still further, a board mounting section 33 is provided in rear of the upper limit stopper mounting section 31 so as to be at a height almost the same as that of the upper limit stopper mounting section 31, as shown in FIG. 3 and FIG. 7. In addition, a switch board 34 is provided above the board mounting section 33 consecutively along the key array direction, and a switch section 35 is provided on the switch board 34, as shown in FIG. 7 and FIG. 8.

Figure 8:
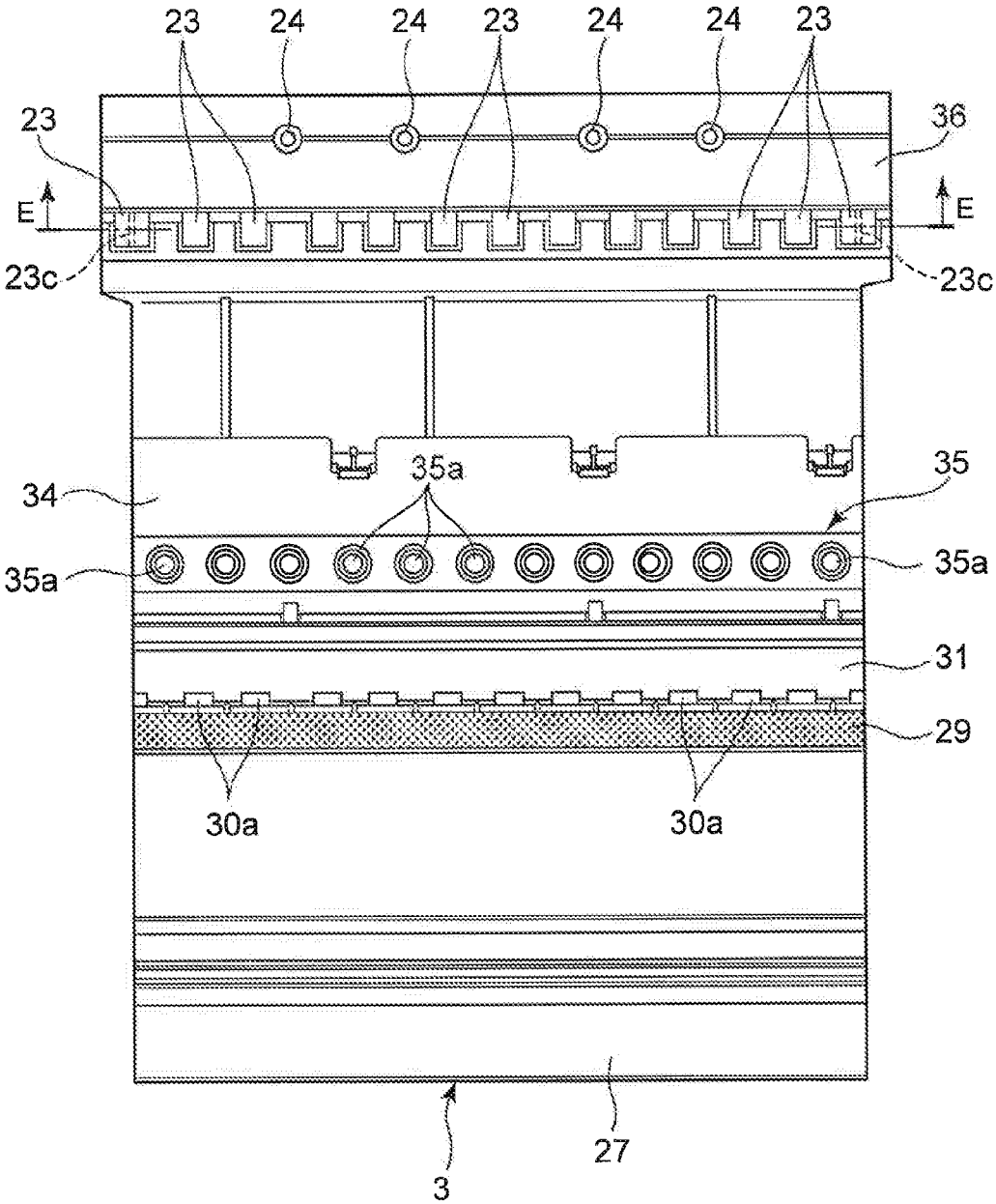
FIG. 8 is an enlarged planar view of the keyboard chassis shown in FIG. 7.

The switch section 35 is structured such that dome-shaped bulging sections 35*a*, each of which corresponds to a switch pressing section 25 of each key body 11, 15, and 19, are formed on a rubber sheet as shown in FIG. 3, FIG. 7 and FIG. 8. A movable contact (not shown) is provided in each of these bulging sections 35*a*, and each movable contact faces a fixed contact (not shown) on the switch board 34 from above such that it can come in contact with and separate from the fixed contact.

As a result, the switch section 35 is structured such that, when the dome-shaped bulging section 35*a* is pressed from above by the switch pressing section 25 of any one of the key bodies 11, 15, and 19, the dome-shaped bulging section 35*a* is elastically deformed, and the movable contact inside the dome-shaped bulging section 35*a* comes into contact with the fixed contact on the switch board 34, whereby a switch signal is outputted.

Additionally, a key mounting section 36 projecting slightly higher than the key cover section 27 is provided in the rear of this keyboard chassis 3 as shown in FIG. 3 and FIG. 7, and the plurality of bearing sections 23 and the plurality of attachment bosses 24 are provided on this key mounting section 36 so as to correspond to each key body 11, 15, and 19.

The plurality of bearing sections 23 are respectively used to rotatably hold the rotating shaft sections 12, 16, and 20 of the key bodies 11, 15, and 19 as shown in FIG. 7 and FIG. 8, and includes substantially semi-circular recess sections 23*a* whose upper portions are open, and circular arc-shaped locking sections 23*b* provided projecting upward on the rear ends (right ends in FIG. 7) of the recess sections 23*a* where both end portions of each rotating shaft section 12, 16, and 20 are located.

Figure 9:
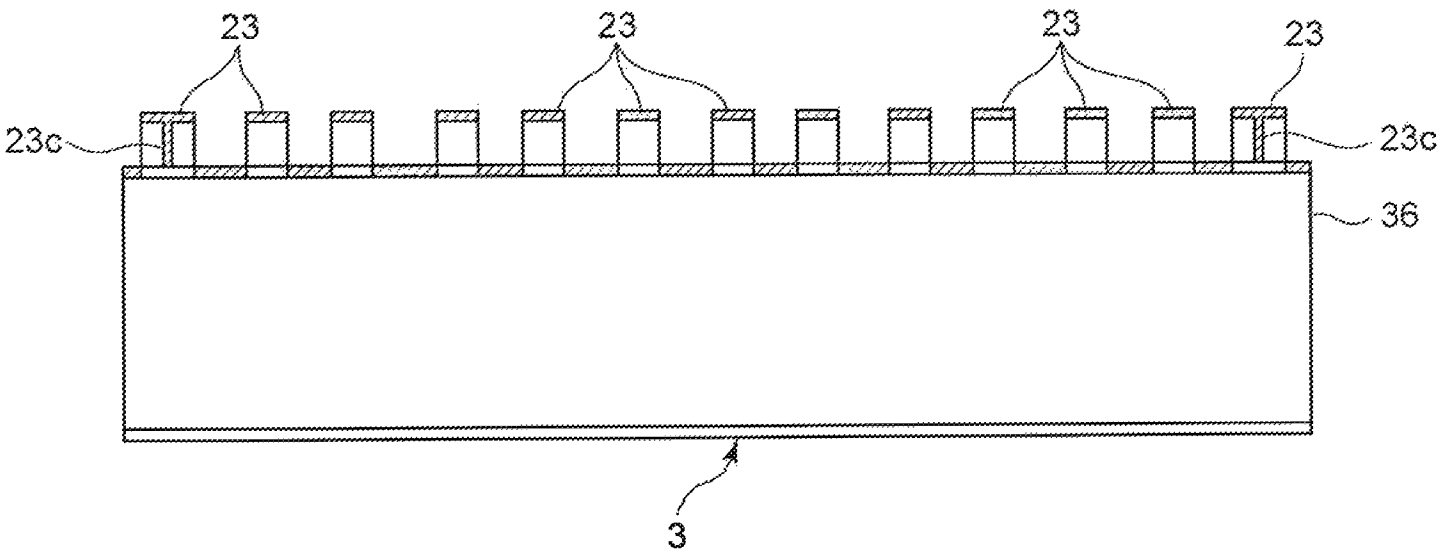
FIG. 9 is an enlarged cross-sectional view of the keyboard chassis taken along line E-E in FIG. 8.

That is, the substantially semi-circular recess sections 23*a* of the bearing sections 23 are provided consecutively along the key array direction, as shown in FIG. 2 and FIG. 8. In addition, each circular arc-shaped locking section 23*b* is provided so as to surround the rear half of both end portions of adjacent rotating shaft sections 12, 16, and 20, together with the recess section 23*a*, as shown in FIG. 2. In this instance, position restricting ribs 23*c* are provided in the circular arc-shaped locking sections 23*b* located in the end portions marking the length of one octave, in order to restrict the positions of the end portions of the rotating shaft sections 12 located on both ends of the first white key unit 8, as shown in FIG. 8 and FIG. 9.

As a result, the plurality of bearing sections 23 are structured such that, when the rotating shaft sections 12, 16, or 20 of the first white key unit 8, the second white key unit 9, or the black key unit 10 are inserted into the recess sections 23*a* from the front side (left side in FIG. 2) of the bearing sections 23, both end portions of each rotating shaft section 12, 16, or 20 are inserted into the circular arc-shaped locking sections 23*b*, whereby the key bodies 11, 15, or 19 is attached so as to be rotatable in the up and down direction, as shown in FIG. 2 and FIG. 3.

Additionally, the plurality of attachment bosses 24 on the key mounting section 36 are respectively provided corresponding to the attachment pieces 14*a*, 18*a*, and 22*a* provided on the connecting sections 14, 18, and 22 of the first white key unit 8, the second white key unit 9, and the black key unit 10, as shown in FIG. 7 and FIG. 8. That is, some of the attachment bosses 24 are provided corresponding to the attachment pieces 14*a* provided on the connecting section 14 of the first white key unit 8, and the others are provided corresponding to the attachment pieces 18*a* provided on the connecting section 18 of the second white key unit 9, or to the attachment pieces 22*a* provided on the connecting section 22 of the black key unit 10.

Next, the assembly of the first white key unit 8, the second white key unit 9, and the black key unit 10 onto the keyboard chassis 3 in the keyboard instrument structured as explained above will be described.

First, the first white key unit 8, the second white key unit 9, and the black key unit 10 are assembled. In this instance, each key body 11 of the first white key unit 8 is arranged between the key bodies 19 of the black key unit 10 from above, and the connecting section 14 of the first white key unit 8 is layered on the connecting section 22 of the black key unit 10.

At this time, the attachment pieces 22*a* provided on the connecting section 22 of the black key unit 10 are arranged between the attachment pieces 14*a* provided on the connecting section 14 of the first white key unit 8. In this state, each key body 15 of the second white key unit 9 is arranged between the key body 19 of the black key unit 10 and the key body 11 of the first white key unit 8 from above, and the connecting section 18 of the second white key unit 9 is layered on the connecting section 14 of the first white key unit 8.

At this time, as shown in FIG. 2, each attachment piece 18*a* provided in the connecting section 18 of the second white key unit 9 is arranged between the attachment pieces 14*a* provided on the connecting section 14 of the first white key unit 14, so as to overlap each attachment piece 22*a* provided on the connecting section 22 of the black key unit 10. As a result, the key bodies 11, 15, and 19 of the first white key unit 8, the second white key unit 9, and the black key unit 10 are arrayed in the order of a musical scale.

Then, the first white key unit 8, the second white key unit 9, and the black key unit 10 are placed on the keyboard chassis 3. At this time, the projecting sections 26*a* of the stopper hook sections 26, which have been provided in the key bodies 11, 15, and 19 of the first white key unit 8, the second white key unit 9, and the black key unit 10 arrayed in the order of a musical scale, correspond to the opening sections 30*a* of the rising section 30 provided on the lower stopper mounting section 28 of the keyboard chassis 3.

In this state, the rotating shaft sections 12, 16, and 20 of the first white key unit 8, the second white key unit 9, and the black key unit 10 are attached to the plurality of bearing sections 23 provided on the key mounting section 36 of the keyboard chassis 3, as shown in FIG. 2 and FIG. 3.

At this time, first, the bendable sections 13, 17, and 21 of the connecting sections 14, 18, and 22 connected to the rotating shafts 12, 16, and 20 of the first white key unit 8, the second white key unit 9, and the black key unit 10 are each inserted between the locking sections 23*b* of the bearing sections 23 of the keyboard chassis 3 from above, whereby the positions of the rotating shaft sections 12, 16, and 20 of the first white key unit 8, the second white key unit 9, and the black key unit 10 are restricted in the key array direction.

In this state, the rotating shaft sections 12, 16, and 20 of the first white key unit 8, the second white key unit 9, and the black key unit 10 are inserted into the recess sections 23*a* of the bearing sections 23 from the front side (left side in FIG. 2) of the bearing sections 23, and both end portions of each rotating shaft section 12, 16, and 20 are inserted into the circular arc-shaped locking sections 23*b* of the bearing sections 23. As a result, the rotating shaft sections 12, 16, and 20 of the first white key unit 8, the second white key unit 9, and the black key unit 10 are rotatably attached to the plurality of bearing sections 23 provided on the key mounting section 36 of the keyboard chassis 3.

At this time, the attachment pieces 13, 17, and 21 provided on the connecting sections 14, 18, and 22 of the first white key unit 8, the second white key unit 9, and the black key unit 10 are arranged on the plurality of attachment bosses 24 provided on the key mounting section 36 of the keyboard chassis 3, and the attachment pieces 14*a*, 18*a*, and 22*a* of the first white key unit 8, the second white key unit 9, and the black key unit 10 are respectively attached onto the attachment bosses 24 of the keyboard chassis 3 by screws 37. As a result, the first white key unit 8, the second white key unit 9, and the black key unit 10 are attached on the keyboard chassis 3.

In this state, as shown in FIG. 2 and FIG. 3, the projecting sections 26*a* of the stopper hook sections 26 of the first white key unit 8, the second white key unit 9, and the black key unit 10 are inserted into the opening sections 30*a* of the rising section 30 provided on the lower limit stopper mounting section 28 of the keyboard chassis 3, in a manner to be movable in the up and down direction. At this time, the switch pressing sections 25 of the first white key unit 8, the second white key unit 9, and the black key unit 10 are arranged so as to correspond to the dome-shaped bulging sections 35*a* of the switch section 35 provided on the switch board 34 above the board mounting section 33 of the keyboard chassis 3.

Next, the usage of the keyboard instrument described above will be described.

When the key bodies 11, 15, and 19 of the first white key unit 8, the second white key unit 9, and the black key unit 10 are depressed, the key bodies 11, 15, and 19 respectively rotate downwards around the rotating shaft sections 12, 16, and 20. At this time, although the connecting sections 14, 18, and 22 of the first white key unit 8, the second white key unit 9, and the black key unit 10 have been fixed to the keyboard chassis 3, the bendable sections 13, 17, and 21 of the first white key unit 8, the second white key unit 9, and the black key unit 10 respectively bend upwards along with the rotations of the rotating shaft sections 12, 16, and 20.

When the key bodies 11, 15, and 19 of the first white key unit 8, the second white key unit 9, and the black key unit 10 rotate downwards around the rotating shaft sections 12, 16, and 20, the respective switch pressing sections 25 of the key bodies 11, 15, and 19 press the switch section 35 on the switch board 34. As a result, the dome-shaped bulging section 35*a* of the switch section is elastically deformed, and the movable contact inside the bulging section comes into contact with the fixed contact on the switch board 34, whereby a switch signal is outputted.

Then, when the key bodies 11, 15, and 19 of the first white key unit 8, the second white key unit 9, and the black key unit 10 rotate further downwards around the rotating shaft sections 12, 16, and 20, the stopper hook sections 26 of the key bodies 11, 15, and 19 come into contact with the lower limit stopper section 29 provided on the lower-limit stopper mounting section 28 of the keyboard chassis 3, and restricts the lower limit positions of the key bodies 11, 15, and 19.

When the key bodies 11, 15, and 19 of the first white key unit 8, the second white key unit 9, and the black key unit 10 are returning to their initial position, the switch pressing sections 25 of the key bodies 11, 15, and 19 are pressed upwards by elastic force generated by the elastic return of each bulging section 35*a* of the switch section 35, and as a result the key bodies 11, 15, and 19 rotate upwards around the rotating shaft sections 12, 16, and 20 and return to their initial position. At this time, the bendable sections 13, 17, and 21 of the first white key unit 8, the second white key unit 9, and the black key unit 10 bend downwards along with the rotation of the rotating shaft sections 12, 16, and 20.

As described above, this keyboard instrument includes: the plurality of key bodies 11, 15, and 19 arrayed in parallel; the plurality of rotating shaft sections 12, 16, and 20 which are respectively provided in the rear end portions of the plurality of key bodies 11, 15, and 19, and serve as rotation fulcrums for the rotations of the plurality of key bodies 11, 15, and 19 in the up and down direction; and the connecting sections 14, 18, and 22 that rotatably connect the plurality of rotating shaft sections 12, 16, and 20 along the key array direction. As a result, the spacing between the key bodies 11, 15, and 19 and the alignment of the key bodies 11, 15, and 19 can be held evenly without using key guides, and the key bodies 11, 15, and 19 can be favorably and stably rotated in the up and down direction.

That is, in the keyboard instrument, the plurality of rotating shaft sections 12, 16, and 20 respectively provided in the rear end portions of the plurality of key bodies 11, 15, and 19 are rotatably connected along the key array direction by the connecting sections 14, 18, and 22, and therefore the respective key bodies 11, 15, and 19 can be integrally formed for each of the first white key unit 8, the second white key unit 9 and the black key unit 10. Accordingly, manufacturability can be improved.

In addition, even when the plurality of key bodies 11, 15, and 19 are integrally formed in this way, rigidity from the front end portion of each key body 11, 15, and 19 to the rotating shaft section 12, 16, and 20 can be ensured. Therefore, the rotating shaft sections 12, 16, and 20 can be evenly arrayed, whereby evenness in the spacing between the key bodies 11, 15, and 19 and the alignment of the key bodies 11, 15, and 19 can be maintained.

Moreover, when the key bodies 11, 15, and 19 are depressed, the key bodies 11, 15, and 19 rotate stably as a result of the rotating shaft sections 12, 16, and 20. Accordingly, an unstable movement, such as a rolling movement in which the key bodies 11, 15, and 19 rotate in the up and down direction while being tilted towards the array direction, can be prevented. Therefore, the spacing between the key bodies 11, 15, and 19 and the alignment of the key bodies 11, 15, and 19 can be held evenly without using key guides, and the key bodies 11, 15, and 19 can be favorably and stably rotated in the up and down direction.

In this instance, the connecting sections 14, 18, and 22 are respectively provided with the bendable sections 13, 17, and 21 which are respectively connected to the rotating shaft sections 12, 16, and 20 and bend in the up and down direction. Therefore, each rotating shaft section 12, 16, and 20 can be rotated independently. That is, when the key bodies 11, 15, and 19 rotate around the respective rotating shaft sections 12, 16, and 20, and the rotating shaft sections 12, 16, and 20 rotate with the respective key bodies 11, 15, and 19, the bendable sections 13, 17, and 21 respectively bend along with the rotation of the rotating shaft sections 12, 16, and 20. Therefore, even when the respective plurality of key bodies 11, 15, and 19 are integrally formed for each of the first white key unit 8, the second white key unit 9, and the black key unit 10, the rotating shaft sections 12, 16, and 20 can be rotated independently with the respective key bodies 11, 15, and 19.

Furthermore, in the keyboard instrument, the plurality of bearing sections 23, which are key supporting sections respectively supporting the plurality of rotating shaft sections 12, 16, and 20 so as to be rotatable in the up and down direction, are provided on the keyboard chassis 3. Therefore, the rotating shaft sections 12, 16, and 20 can be rotatably held favorably and unfailingly by the plurality of bearing sections 23. As a result, the spacing between the key bodies 11, 15, and 19 and the alignment of the key bodies 11, 15, and 19 can be held evenly without using key guides, and the key bodies 11, 15, and 19 can be favorably and stably rotated in the up and down direction.

That is, in the keyboard instrument, the respective rotating shaft sections 12, 16, and 20 provided in the rear end portions of the plurality of key bodies 11, 15, and 19 can be held evenly by the plurality of bearing sections 23 provided on the keyboard chassis 3, in a manner to be rotatable in the up and down direction. As a result, spacing between the key bodies 11, 15, and 19 and alignment of the key bodies 11, 15, and 19 can be held evenly. Therefore, an unstable movement when the key bodies 11, 15, and 19 are depressed, such as a rolling movement in which the key bodies 11, 15, and 19 rotate in the up and down direction while being tilted towards the array direction, can be prevented.

In this case as well, the plurality of rotating shaft sections 12, 16, and 20 respectively provided in the rear end portions of the key bodies 11, 15, and 19 are connected along the key array direction by the connecting sections 14, 18, and 22. Therefore, the plurality of key bodies 11, 15, and 19 are integrally formed for each of the first white key unit 8, the second white key unit 9, and the black key unit 10. In this state, the first white key unit 8, the second white key unit 9, and the black key unit 10 can be mounted to the keyboard chassis 3 all at once.

Even when the first white key unit 8, the second white key unit 9, and the black key unit 10 are mounted to the keyboard chassis 3 as just described, each rotating shaft section 12, 16, and 20 can be independently and favorably rotated with the respective key body 11, 15, and 19 by bending the respective bendable sections 13, 17, and 21 of the connecting sections 14, 18, and 22 in the up and down direction.

Also, in the keyboard instrument, the plurality of bearing sections 23 respectively rotatably supporting the plurality of rotating shaft sections 12, 16, and 20 includes the semicircular recess sections 23*a* which are consecutive in the key array direction and whose upper portions are open, and the circular arc-shaped locking sections 23*b* which are provided on the rear ends of the recess sections 23*a* where both end portions of each rotating shaft section 12, 16, and 20 are located, and surround the rear half of both end portions of adjacent rotating shaft sections 12, 16, and 20, together with the recess section 23*a*. Therefore, the plurality of rotating shaft sections 12, 16, and 20 can be rotatably attached to the plurality of bearing sections 23 easily and unfailingly.

That is, the rotating shaft sections 12, 16, and 20 can be rotatably attached to the bearing sections 23 easily and unfailingly by the plurality of rotating shaft sections 12, 16, and 20 being respectively inserted into the recess sections 23*a* of the bearing sections 23 from the front side of the bearing sections 23 (left side in FIG. 2), and both end portions of each rotating shaft section 12, 16, and 20 being inserted into the circular arc-shaped locking sections 23*b* of the bearing sections 23.

In addition, the bendable sections 13, 17, and 21 connected to the rotating shaft sections 12, 16, and 20 are each arranged by being inserted between the locking sections 23*b* of the bearing sections 23 from above, whereby the positions of the rotating shaft sections 12, 16, and 20 can be restricted in the key array direction. As a result, the key bodies 11, 15, and 19 can be evenly and favorably arrayed on the keyboard chassis 3, whereby the spacing between the key bodies 11, 15, and 10 and the alignment of the key bodies 11, 15, and 19 can be held more evenly.

Moreover, among the plurality of bearing sections 23, the circular arc-shaped locking sections 23*b* of the bearing sections 23 located in the both end portions marking the length of an octave are provided with the position restricting ribs 23*c*. The position restricting ribs 23*c* restrict the positions of the end portions of the rotating shaft sections 12 provided on both sides of the first white key unit 8, among all the rotating shaft sections 12, 16, and 20. This also enables the positions of the rotating shaft sections 12, 16, and 20 to be precisely and favorably restricted in the key array direction.

Second Embodiment

Next, a second embodiment in which the present invention has been applied to a keyboard instrument will be described with reference to FIG. 10 to FIG. 14. Sections that are the same as those of the first embodiment shown in FIG. 1 to FIG. 9 are described using the same reference numerals.

Figure 10:
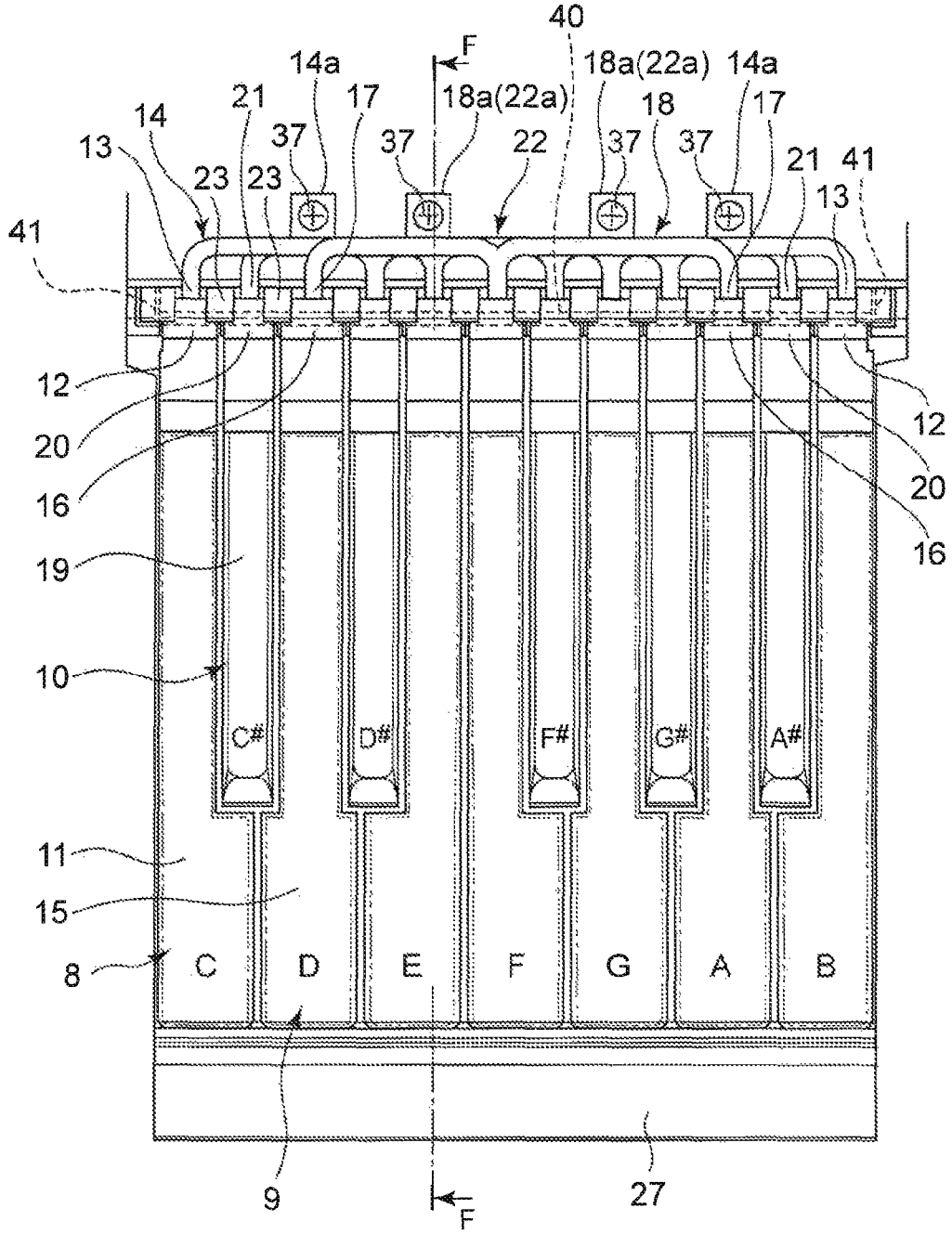
FIG. 10 is an enlarged planar view showing the main portion of the keyboard section of a second embodiment in which the present invention has been applied to a keyboard instrument.
Figure 11:
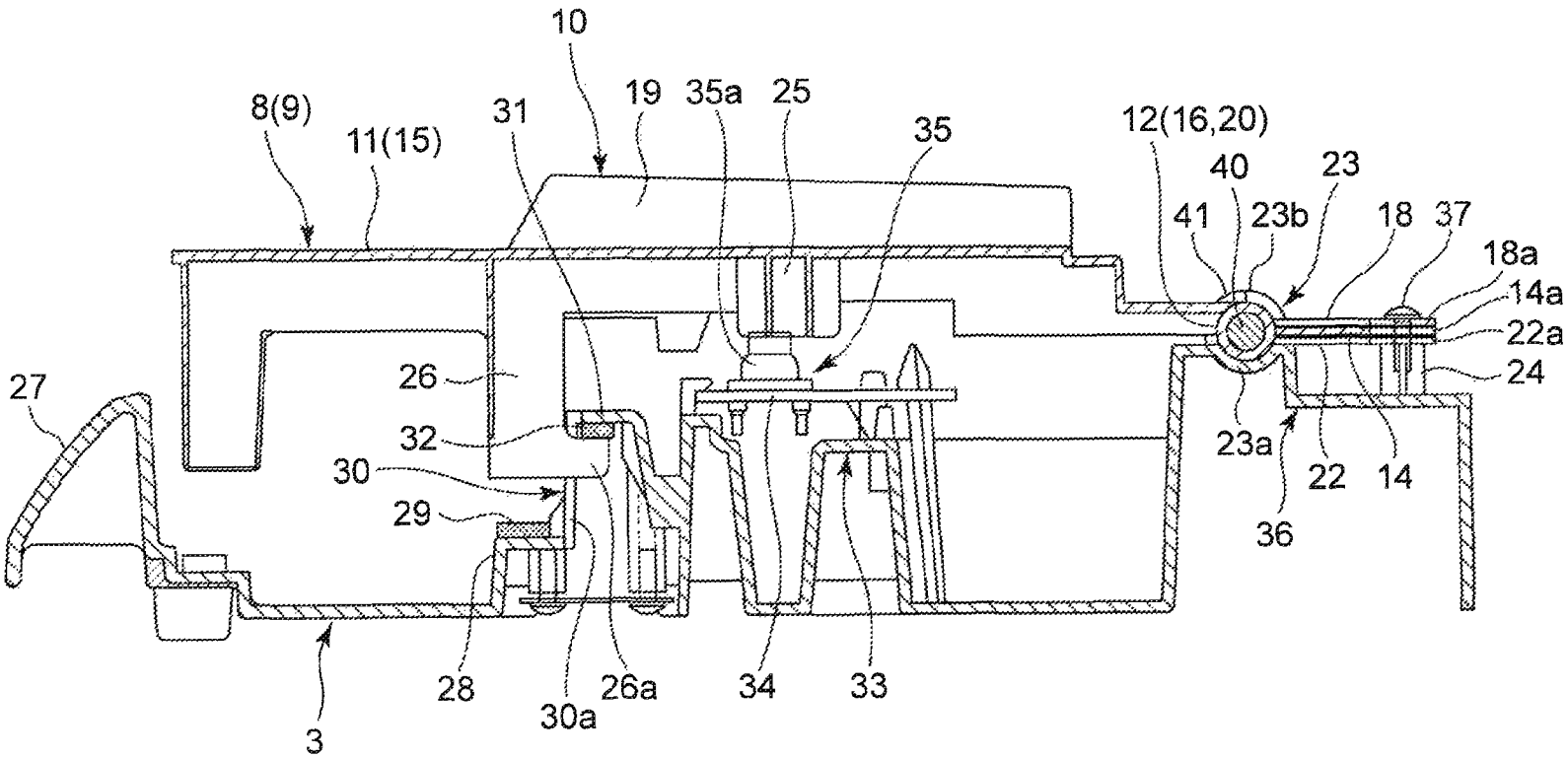
FIG. 11 is an enlarged cross-sectional view of the keyboard section taken along line F-F in FIG. 10.
Figure 12:
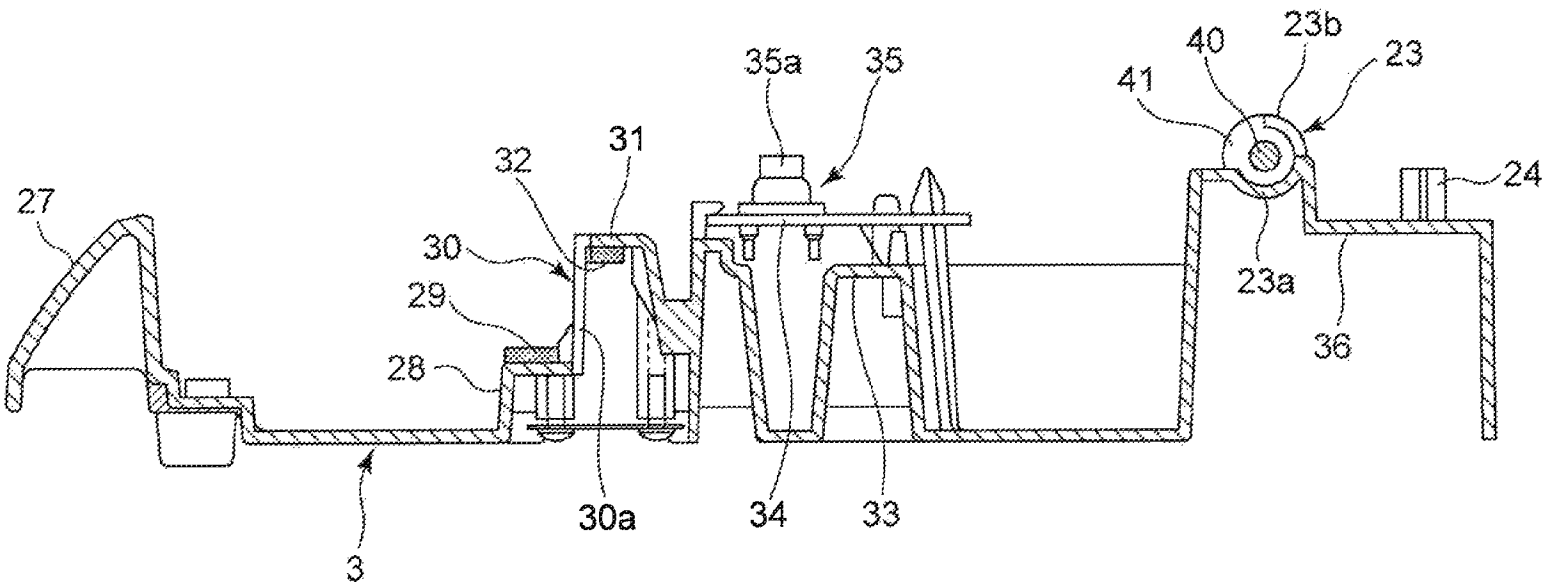
FIG. 12 is an enlarged cross-sectional view of the keyboard chassis of the keyboard section shown in FIG. 11.

This keyboard instrument has a structure that is almost the same as that of the first embodiment except for the supporting structure of the rotating shaft sections 12, 16, and 20 provided in the rear end portions of the key bodies 11, 15, and 19, as shown in FIG. 10 and FIG. 11.

In this instance, shaft holes 12*a*, 16*a*, and 20*a* passing through in the key array direction are respectively provided in the rotating shaft sections 12, 16, and 20, as shown in FIG. 10 and FIG. 11. These shaft holes 12*a*, 16*a*, and 20*a* are coaxially formed such that one supporting shaft 40 of a length equivalent to the length of one octave is consecutively inserted.

Figure 13:
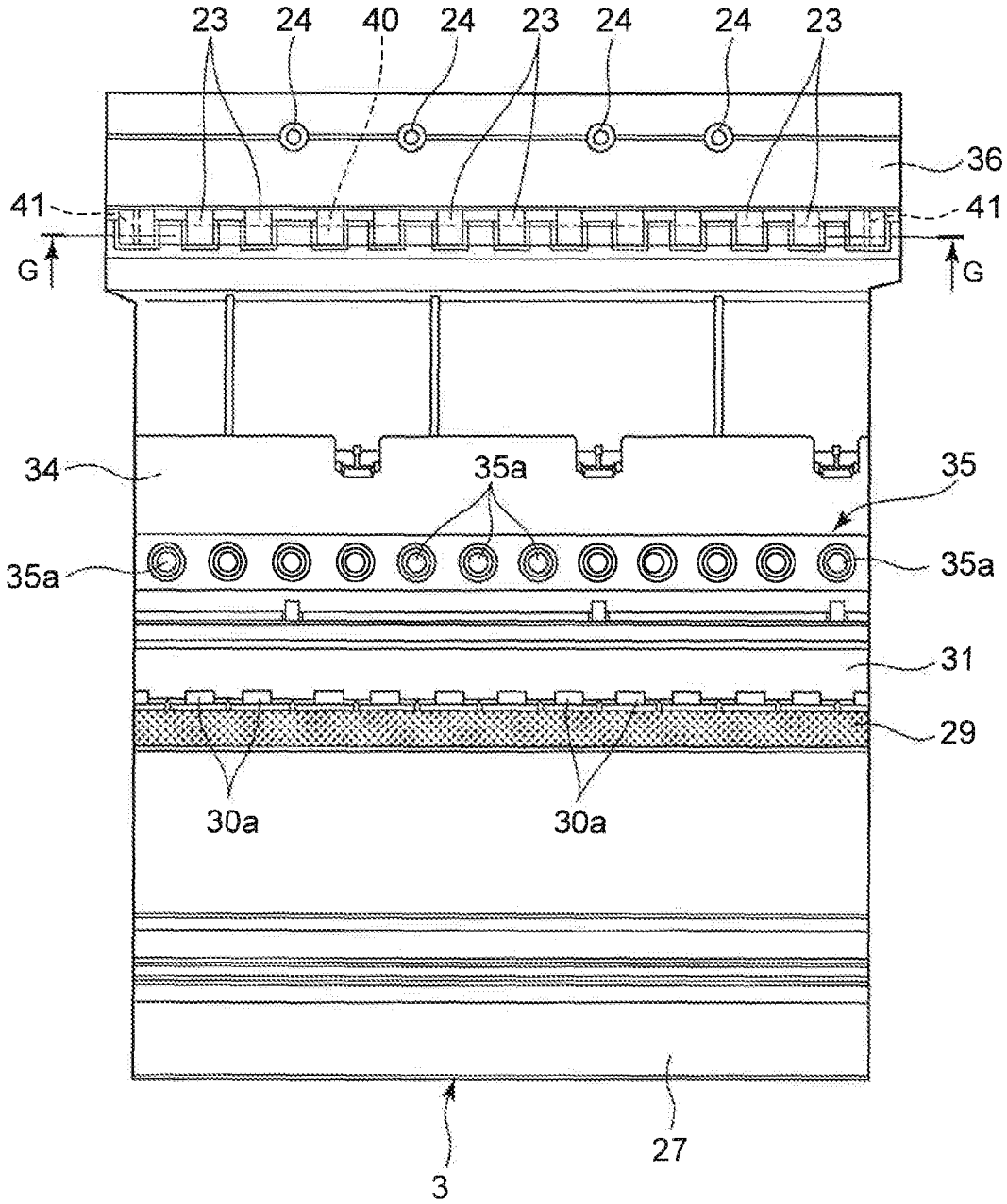
FIG. 13 is an enlarged planar view of the keyboard chassis shown in FIG. 12.
Figure 14:
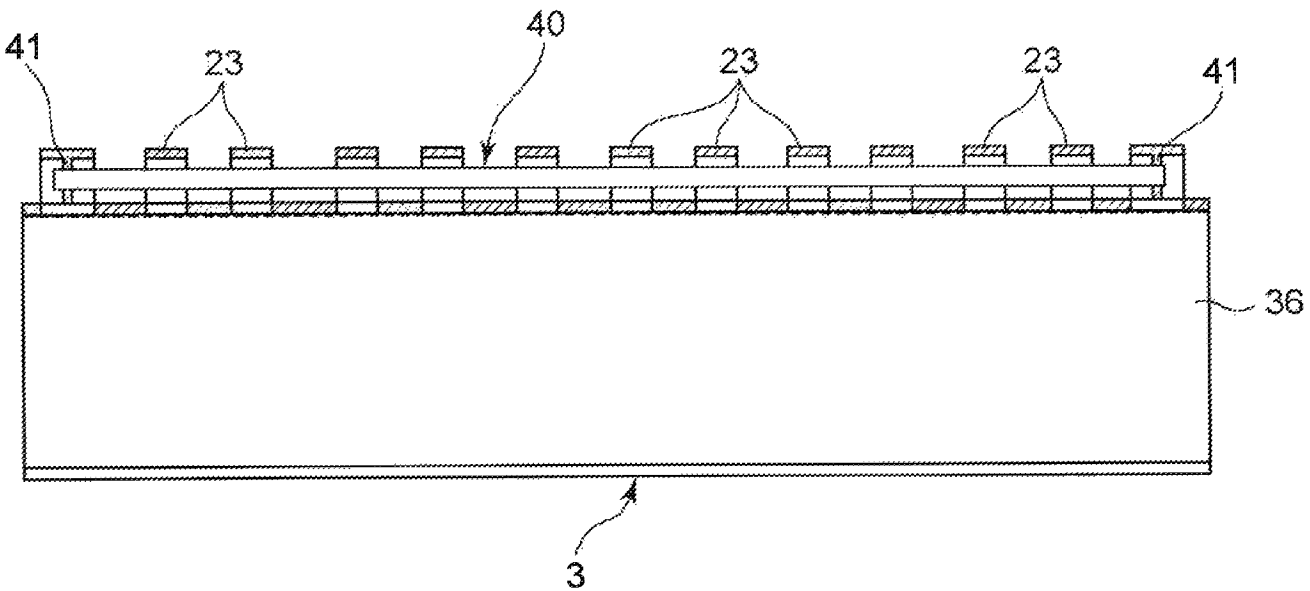
FIG. 14 is an enlarged cross-sectional view of the keyboard chassis taken along line G-G in FIG. 13.

The supporting shaft 40 is structured such that its both end portions are supported by a pair of shaft supporting sections 41 provided on the key mounting section 36 of the keyboard chassis 3, as shown in FIG. 13 and FIG. 14. As a result, the key bodies 11, 15, and 19 of the first white key unit 8, the second white key unit 9, and the black key unit 10 are structured to rotate in the up and down direction around the supporting shaft 40 to which the respective rotating shaft sections 12, 16, and 20 are rotatably attached, as shown in FIG. 10 and FIG. 11.

In this instance as well, for each of the first white key unit 8, the second white key unit 9, and the black key unit 10, the rotating shaft sections 12, 16, and 20 are respectively connected to the connecting sections 14, 18, and 22 via the bendable sections 13, 17, and 21, as in the case of the first embodiment. In addition, the plurality of bearing sections 23 which rotatably hold the respective rotating shaft sections 12, 16, and 20 are provided on the key mounting section 36 located in the rear of the keyboard chassis 3, as in the case of the first embodiment.

In this keyboard instrument, the following advantageous effects can be achieved in addition to the advantageous effects achieved by the first embodiment. First, this keyboard instrument is structured such that the shaft holes 12*a*, 16*a*, and 20*a* passing through in the key array direction are respectively provided in the plurality of rotating shaft sections 12, 16, and 20, a single supporting shaft 40 is consecutively inserted into these shaft holes 12*a*, 16*a*, and 20*a*, and the rotating shaft sections 12, 16, and 20 are held so as to be rotatable in the up and down direction by this single supporting shaft 40. Therefore, the first white key unit 8, the second white key unit 9, and the black key unit 10 can be easily mounted to the keyboard chassis 3 at once, without the key bodies 11, 15, and 19 becoming separated for each of the first white key unit 8, the second white key unit 9, and the black key unit 10.

In this instance, the keyboard chassis 3 is provided with the pair of shaft supporting sections 41 which are key supporting sections supporting the single supporting shaft 40 to which the rotating shaft sections 12, 16, and 20 of the first white key unit 8, the second white key unit 9, and the black key unit 10 are attached. Accordingly, it is only required that both end portions of the supporting shaft 40 are attached to the pair of shaft supporting sections 41. This also enables the first white key unit 8, the second white key unit 9, and the black key unit 10 to be easily mounted to the keyboard chassis 3 at once. As a result, the assembly operation can be simplified.

As described above, in the second embodiment, the bearing sections 23 that rotatably hold the rotating shaft sections 12, 16, and 20 are provided on the key mounting section 36 of the keyboard chassis 3. However, the bearing sections 23 are not necessarily required, and a structure may be adopted in which the pair of shaft supporting sections 41 are provided on the key mounting section 36 of the keyboard chassis 3, and both end portions of the supporting shaft 40 are supported by the pair of shaft supporting sections 41. As a result, the structure of the keyboard chassis 3 can be simplified.

Third Embodiment

Next, a third embodiment in which the present invention has been applied to a keyboard instrument will be described with reference to FIG. 15 to FIG. 20. Sections that are the same as those of the second embodiment shown in FIG. 10 to FIG. 14 are described using the same reference numerals.

Figure 15:
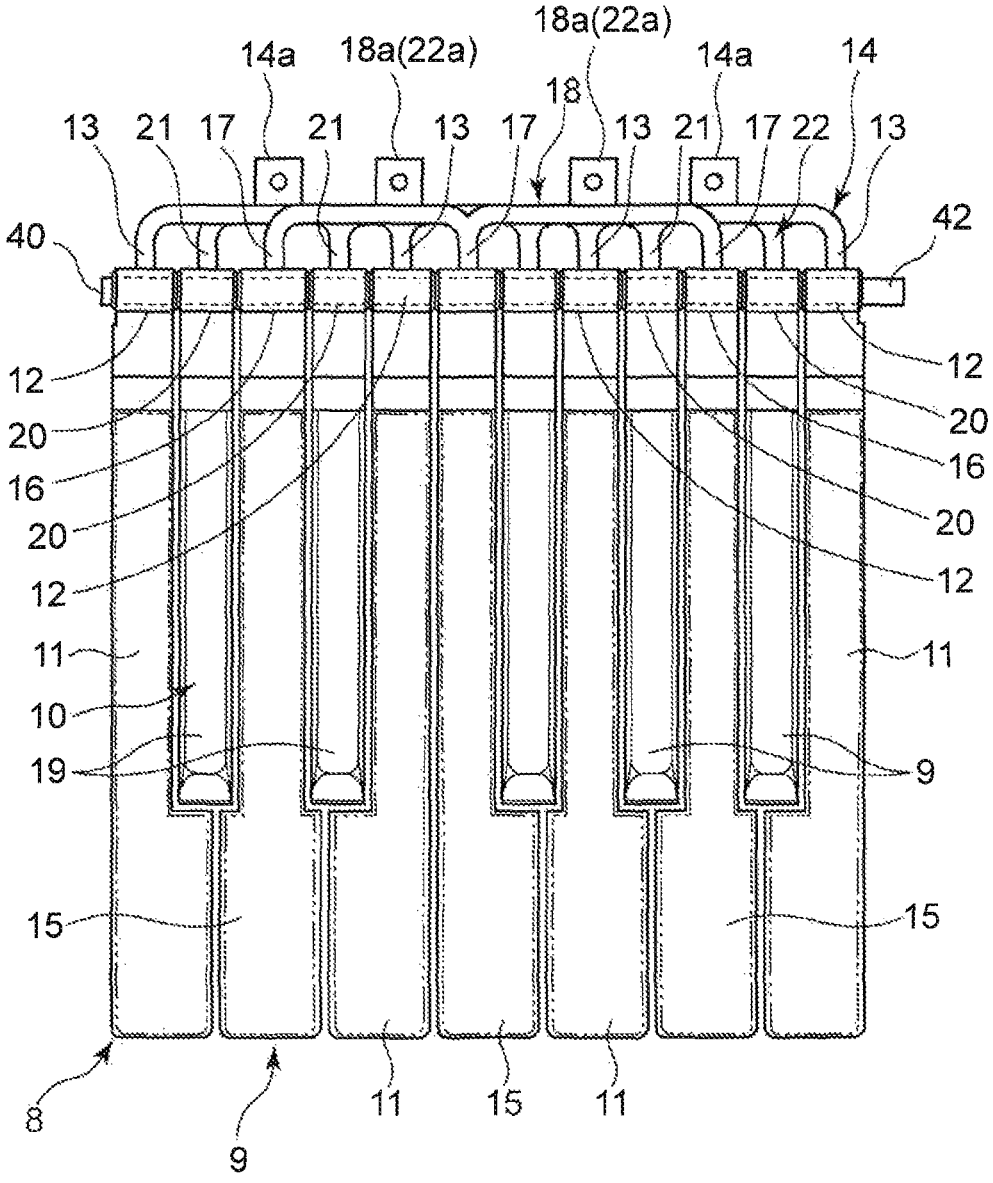
FIG. 15 is an enlarged planar view showing the main portion of the keyboard section of a third embodiment in which the present invention has been applied to a keyboard instrument.
Figure 16:
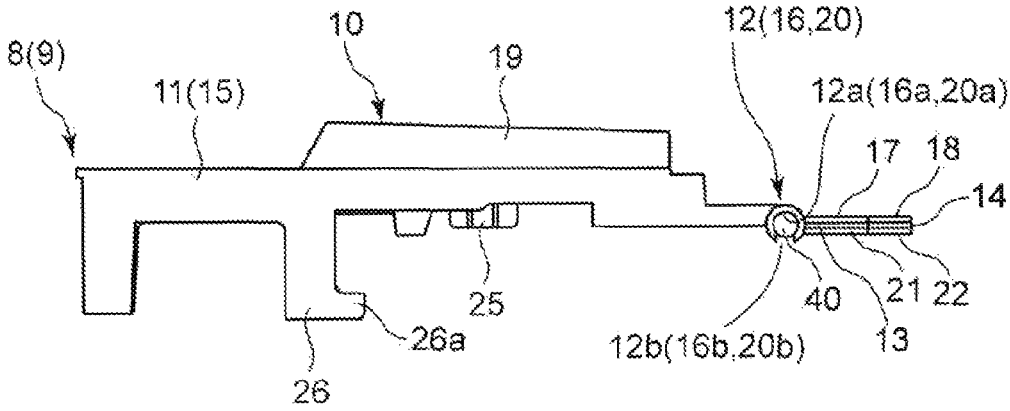
FIG. 16 is an enlarged side view of the keyboard section shown in FIG. 15 when viewed from the right side.
Figure 17:
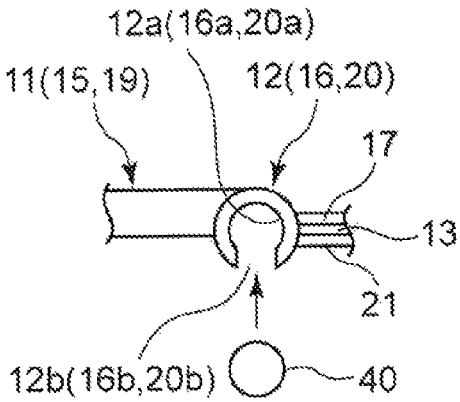
FIG. 17 is an enlarged side view of a main portion where a supporting shaft is relatively inserted from below into a shaft hole of a rotating shaft section in the keyboard section shown in FIG. 16.

This keyboard instrument has a structure that is almost the same as that of the second embodiment except for the attachment structure for attaching the supporting shaft 40 to the rotating shaft sections 12, 16, and 20 respectively provided in the rear end portions of the plurality of key bodies 11, 15, and 19 of the first white key unit 8, the second white key unit 9, and the black key unit 10, as shown in FIG. 15 to FIG. 17.

Figure 20A:
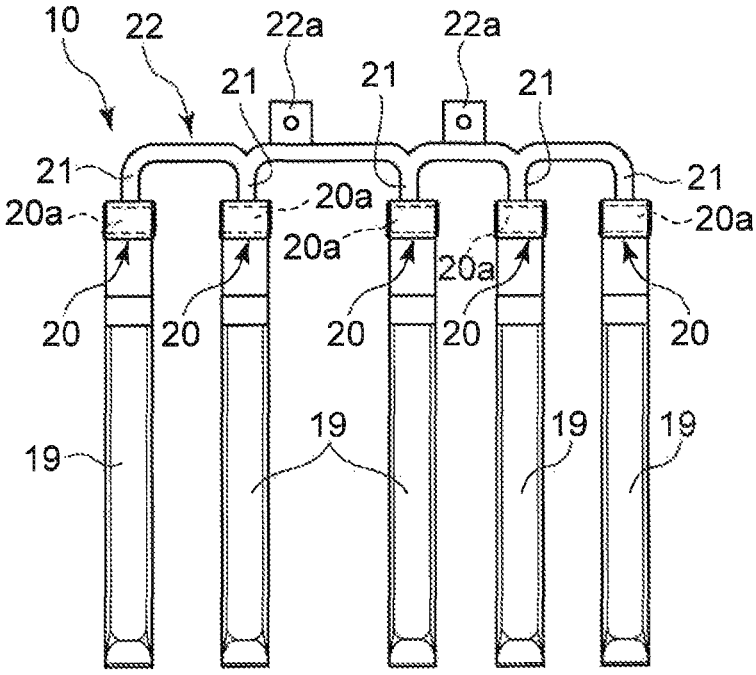
FIG. 20A is an enlarged planar view of a black key unit in the keyboard section shown in FIG. 15.
Figure 20B:
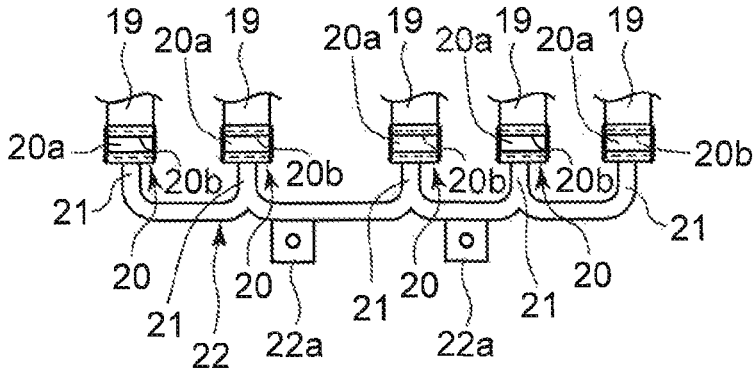
FIG. 20B is an enlarged rear view showing the main portion of the black key unit in the keyboard section shown in FIG. 15.

That is, as shown in FIG. 16 and FIG. 20, the shaft holes 12*a*, 16*a*, and 20*a* passing through in the key array direction, into which the supporting shaft 40 is rotatably inserted, are respectively provided in the rotating shaft sections 12, 16, and 20 of the first white key unit 8, the second white key unit 9, and the black key unit 10. In addition, notched sections 12*b*, 16*b*, and 20*b*, from which the supporting shaft 40 is relatively inserted into the shaft holes 12*a*, 16*a*, and 20*a* from below in the up and down direction perpendicular to the axial direction of the supporting shaft 40, are also respectively provided in the rotating shaft sections 12, 16, and 20. These notched sections 12*b*, 16*b*, and 20*b*, each of which has a notch width slightly shorter than the outer diameter of the supporting shaft 40, are respectively formed in the undersurfaces of the rotating shaft sections 12, 16, and 20, along the axial direction.

As a result, the rotating shaft sections 12, 16, and 20 of the first white key unit 8, the second white key unit 9, and the black key unit 10 are structured such that the supporting shaft 40 is not required to be sequentially inserted into the shaft holes 12*a*, 16*a*, and 20*a* along the array direction of the key bodies 11, 15, and 19, and the supporting shaft 40 can be inserted into the shaft holes 12*a*, 16*a*, and 20*a* through the respective notched sections 12*b*, 16*b*, and 20*b* of the rotating shaft sections 12, 16, and 20 in the key bodies 11, 15, and 19 of the first white key unit 8, the second white key unit 9, and the black key unit 10.

Figure 18A:
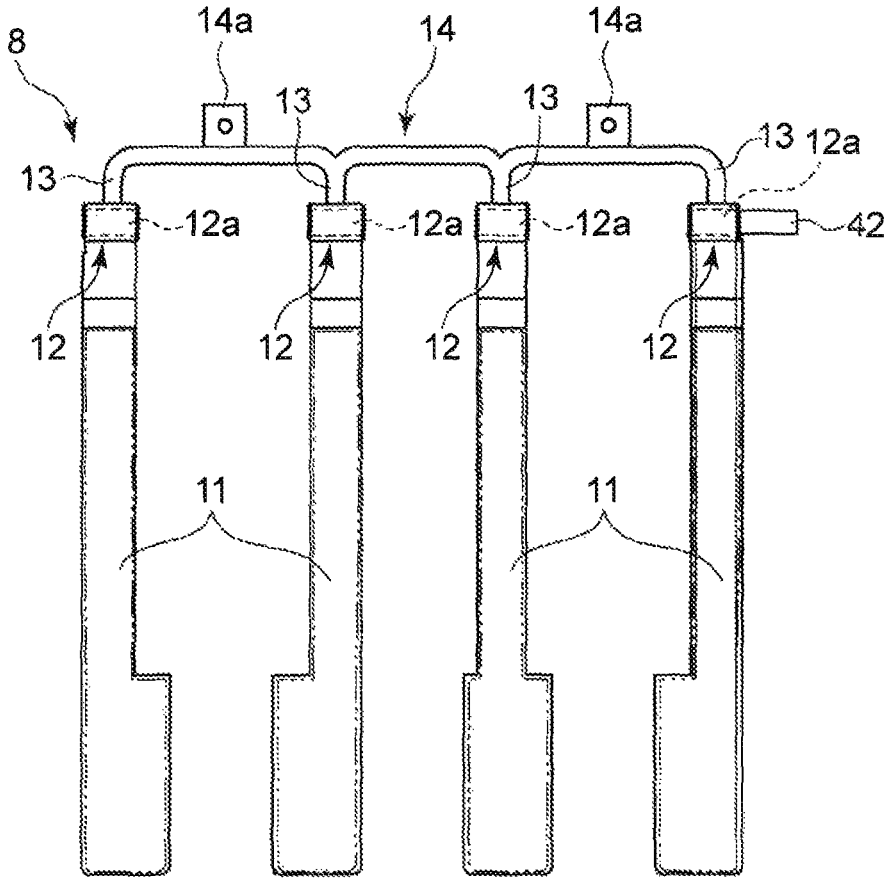
FIG. 18A is an enlarged planar view of a first white key unit in the keyboard section shown in FIG. 15.
Figure 18B:
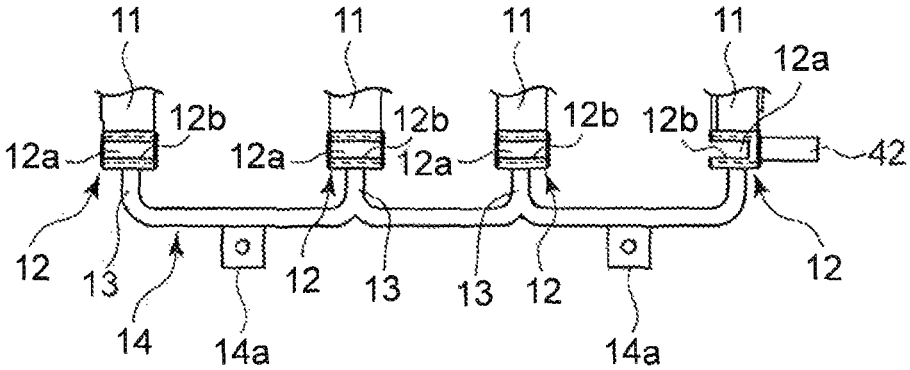
FIG. 18B is an enlarged rear view showing the main portion of the first white key unit in the keyboard section shown in FIG. 15.
Figure 19A:
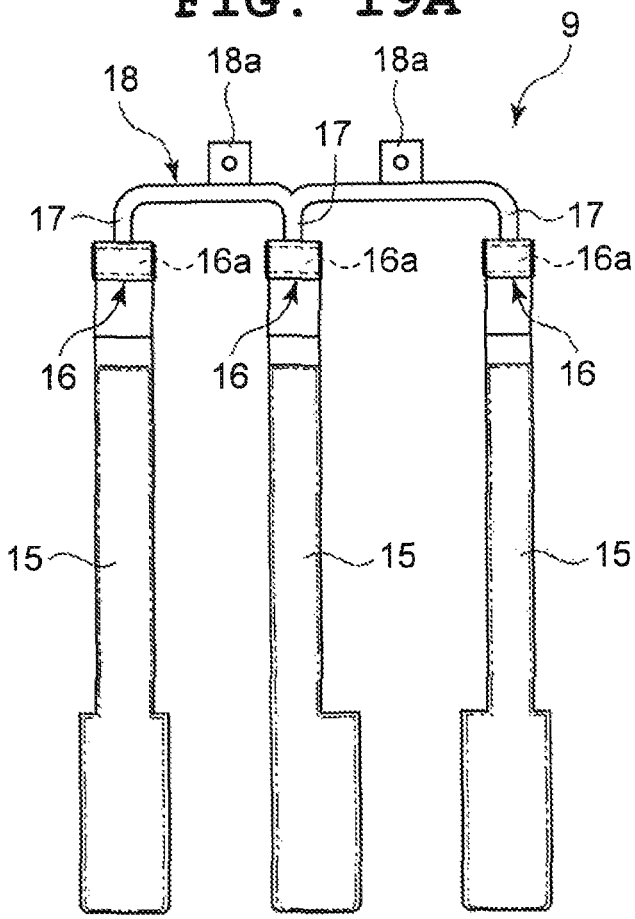
FIG. 19A is an enlarged planar view of a second white key unit in the keyboard section shown in FIG. 15.
Figure 19B:
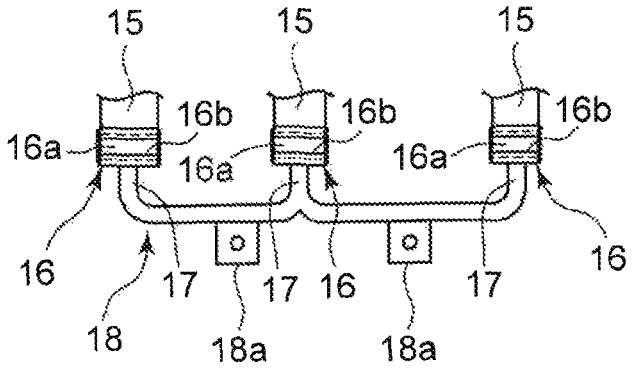
FIG. 19B is an enlarged rear view showing the main portion of the second white key unit in the keyboard section shown in FIG. 15.

In this instance, among the key bodies 11, 15, and 19 of the first white key unit 8, the second white key unit 9, and the black key unit 10, the rotating shaft section 12 of the key body 11 positioned on the highest note side is provided with a connecting shaft 42 that protrude along the array direction of the key bodies 11 from the end surface on the high note side, as shown in FIG. 18A and FIG. 18B.

As shown in FIG. 18A and FIG. 18B, the connecting shaft 42 is formed such that its protruding length is almost the same as the length of the rotating shaft section 12 of the key body 11 located on the lowest note side in another first white key unit 8 which is on the high note side and adjacent to the connecting shaft 42. That is, the projection length is almost the same as the length of the rotating shaft section 12 in the array direction of the key bodies 11.

As a result, the connecting shaft 42 is structured to connect the first white key unit 8 on the low note side with the adjacent another first white key unit 8 on the high note side, by being inserted into the shaft hole 12*a* of the rotating shaft section 12 located on the lowest note side in the adjacent first white key unit 8 on the high note side through the notched section 12*b*.

In this keyboard instrument, the following advantageous effects can be achieved in addition to the advantageous effects achieved by the first embodiment. First, this keyboard instrument is structured such that the shaft holes 12*a*, 16*a*, and 20*a* into which the supporting shaft 40 is inserted are respectively provided in the rotating shaft sections 12, 16, and 20 of the plurality of key bodies 11, 15, and 19, and the notched sections 12*b*, 16*b*, and 20*b*, from which the supporting shaft 40 is relatively inserted into the shaft holes 12*a*, 16*a*, and 20*a* from the up and down direction, are respectively provided in the rotating shaft sections 12, 16, and 20. Therefore, the supporting shaft 40 is not required to be sequentially inserted into the shaft holes 12*a*, 16*a*, and 20*a* along the array direction of the key bodies 11, 15, and 19, and the rotating shaft sections 12, 16, and 20 of the first white key unit 8, the second white key unit 9, and the black key unit 10 can be easily attached to the supporting shaft 40 from the up and down direction.

That is, in this keyboard instrument, the supporting shaft 40 can be inserted into the shaft holes 12*a* from the notched sections 12*b* of the respective rotating shaft sections 12 in the key bodies 11 of the first white key unit 8 when the first white key unit 8 is attached to the supporting shaft 40. Similarly, the supporting shaft 40 can be inserted into the shaft holes 16*a* from the notched sections 16*b* of the respective rotating shaft sections 16 in the key bodies 15 of the second white key unit 9 when the second white key unit 9 is attached to the supporting shaft 40. In addition, the supporting shaft 40 can be inserted into the shaft holes 20*a* from the notched sections 20*b* of the respective rotating shaft sections 20 in the key bodies 19 of the black key unit 10 when the black key unit 10 is attached to the supporting shaft 40.

Accordingly, in this keyboard instrument, the key bodies 11 of the first white key unit 8 can be arranged between the key bodies 19 of the black key unit 10 from above with the rotating shaft sections 20 of the black key unit 10 being attached to the supporting shaft 40, and the rotating shaft sections 12 can be attached to the supporting shaft 40 by the supporting shaft 40 being inserted into the shaft holes 12*a* of the rotating shaft sections 12 from the notched sections 12*b*. In addition, the key bodies 15 of the second white key unit 9 can be arranged between the key bodies 19 of the black key unit 10 and the key bodies 11 of the first white key unit 8 from above, and the rotating shaft sections 16 can be attached to the supporting shaft 40 by the supporting shaft 40 being inserted into the shaft holes 16*a* of the rotating shaft sections 16 from the notched sections 16*b*.

As a result, in this keyboard instrument, the first white key unit 8, the second white key unit 9, and the black key unit 10 can be more simply and easily attached to the supporting shaft 40 compared to that of the second embodiment. Additionally, as in the case of the second embodiment, the first white key unit 8, the second white key unit 9, and the black key unit 10 can be easily mounted to the keyboard chassis 3 at once, without the key bodies 11, 15, and 19 becoming separated for each of the first white key unit 8, the second white key unit 9, and the black key unit 10.

Moreover, among the key bodies 11, 15, and 19 of the first white key unit 8, the second white key unit 9, and the black key unit 10, the rotating shaft section 12 of the key body 11 located on the highest note side is provided with the connecting shaft 42 that protrudes along the array direction of the key bodies 11 from the end surface on the high note side. Therefore, in this keyboard instrument, the first white key unit 8 on the low note side can be easily connected with the adjacent another first white key unit 8 on the high note side, by the connecting shaft 42 being inserted from the notched section 12*b* into the shaft hole 12*a* of the rotating shaft section 12 located on the lowest note side in the adjacent first white key unit 8 on the high note side.

As described above, in the third embodiment as well, the bearing sections 23 that rotatably hold the rotating shaft sections 12, 16, and 20 are provided on the key mounting section 36 of the keyboard chassis 3. However, the bearing sections 23 are not necessarily required, and a structure may be adopted in which the pair of shaft supporting sections 41 are provided on the key mounting section 36 of the keyboard chassis 3, and both end portions of the supporting shaft 40 are supported by the pair of shaft supporting sections 41. As a result, the structure of the keyboard chassis 3 can be simplified.

Fourth Embodiment

Next, a fourth embodiment in which the present invention has been applied to a keyboard instrument will be described with reference to FIG. 21 and FIG. 22. Sections that are the same as those of the third embodiment shown in FIG. 15 to FIG. 20B are described using the same reference numerals.

This keyboard instrument has a structure that is almost the same as that of the third embodiment except that the first white key unit 8, the second white key unit 9, and the black key unit 10 are connected without using the supporting shaft 40.

Figure 21:
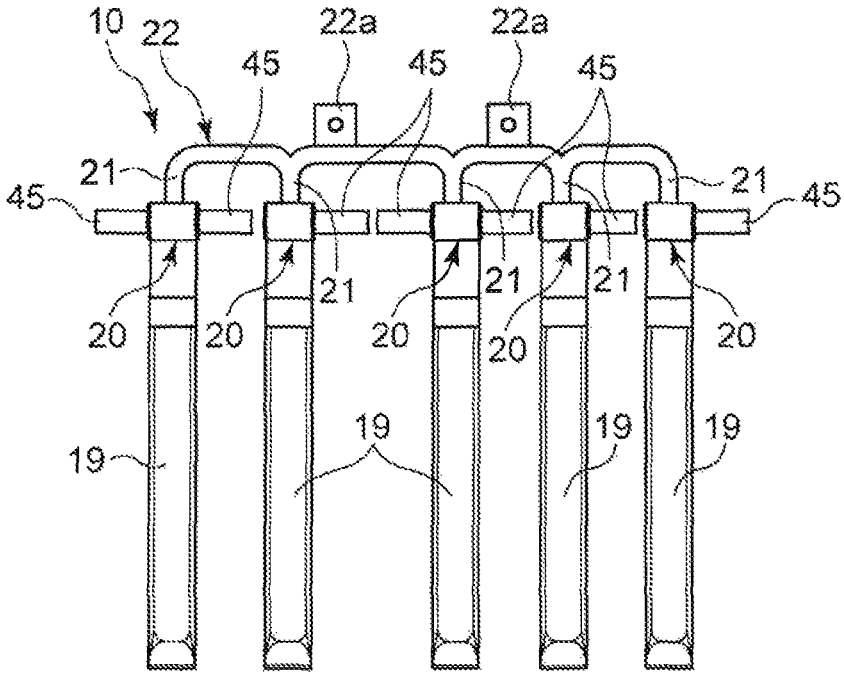
FIG. 21 is an enlarged planar view of a black key unit according to a fourth embodiment in which the present invention has been applied to a keyboard instrument.

That is, among the connecting sections 14, 18, and 21 of the first white key unit 8, the second white key unit 9, and the black key unit 10, the rotating shaft sections 20 of the black key unit 10 having the bottommost connecting section 21 when the connecting sections 14, 18, and 21 are layered are each formed into a circular rod shape, and each rotating shaft section 20 of the black key unit 10 is provided with a protruding shaft 45 that protrudes in the array direction of the key body 19 from each end surface, as shown in FIG. 21.

Figure 22:
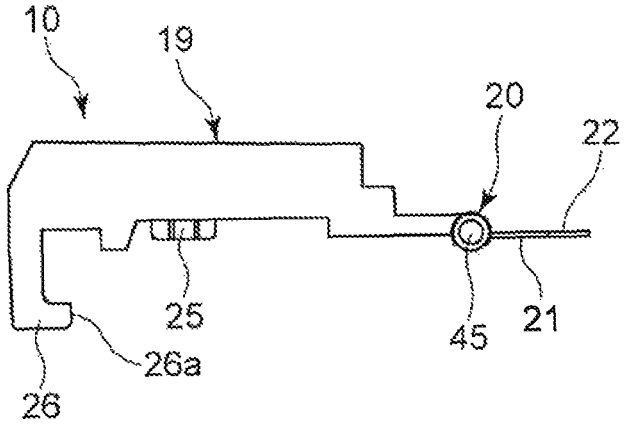
FIG. 22 is an enlarged side view of the black key unit shown in FIG. 21 when viewed from the right side.

The shaft diameter of this protruding shaft 45 is smaller than the outer diameter of the rotating shaft section 20, and is almost the same size as the inner diameter of the respective shaft holes 12*a* and 16*a* in the rotating shaft sections 12 and 16 of the first white key unit 8 and the second white key unit 9, as shown in FIG. 21 and FIG. 22. The length of the protruding shaft 45 that projects from the end surface of the rotating shaft section 20 is almost the same as the axial direction lengths of the respective rotating shaft sections 12 and 16 of the first white key unit 8 and the second white key unit 9 or slightly shorter than them. As shown in FIG. 21, the protruding shaft 45 is provided on an end surface (right end surface in FIG. 21) located on the high note side of each rotating shaft sections 20.

In this instance, the projection shaft 45 is also provided on an end surface (left end surface in FIG. 21) on the low note side of the rotating shaft section 20 located on the lowest note side, and an end surface (left end surface in FIG. 21) on the low note side of the rotating shaft section 20 in the area where two key bodies, the key bodies 11 and 15 of the first white key unit 8 and the second white key unit 9, are arranged, as shown in FIG. 21. As a result, the protruding shafts 45 are consecutively and coaxially arrayed in the key array direction.

On the other hand, the first white key unit 8 and the second white key unit 9 are structured such that the shaft holes 12*a* and 16*a* passing through in the key array direction are respectively provided in the rotating shaft sections 12 and 16 in the rear end portions of the key bodies 11 and 15, as in the case of the third embodiment shown in FIG. 18A to FIG. 19B. These shaft holes 12*a* and 16*a* are formed such that the protruding shafts 45 respectively provided in the rotating shaft sections 20 of the black key unit 10 are rotatably inserted therein.

In addition, the notched sections 12*b* and 16*b* from which the protruding shafts 45 of the rotating shaft sections 20 of the black key unit 10 are relatively inserted into the shaft holes 12*a* and 16*a* from below in the up and down direction perpendicular to the axial direction of the protruding shafts 45 are respectively provided in the rotating shaft sections 12 and 16 of the first white key unit 8 and the second white key unit 9, as in the case of the third embodiment shown in FIG. 18A to FIG. 19B. These notched sections 12*b* and 16*b*, each of which has a notch width slightly shorter than the outer diameter of the protruding shaft 45, are respectively formed in the undersurfaces of the rotating shaft sections 12 and 16, along the axial direction.

As a result, the first white key unit 8, the second white key unit 9, and the black key unit 10 are structured such that the key bodies 11 and 15 of the first white key unit 8 and the second white key unit 9 are arranged between the key bodies 19 of the black key unit 10, the protruding shafts 45 provided in the rotating shaft sections 20 of the black key unit 10 are relatively inserted into the shaft holes 12*a* and 16*a* from the respective notched sections 12*b* and 16*b* of the rotating shaft sections 12 and 16 of the first white key unit 8 and the second white key unit 9, whereby the first white key unit 8, the second white key unit 9, and the black key unit 10 are integrally connected.

In this keyboard instrument, the following advantageous effects can be achieved in addition to the advantageous effects achieved by the first embodiment. First, in the structure of this keyboard instrument, the protruding shafts 45 that project in the key array direction from the end surfaces of the rotating shaft sections 20 are provided in the rotating shaft sections 20 of any unit, such as the black key unit 10, among the first white key unit 8, the second white key unit 9, and the black key unit 10, and the shaft holes 12*a* and 16*a* passing through in the key array direction are respectively provided in the rotating shaft sections 12 and 16 of the other units, such as the first white key unit 8 and the second white key unit 9. In addition, the notched sections 12*b* and 16*b*, from which the protruding shafts 45 are relatively inserted into the shaft holes 12*a* and 16*a* from the up and down direction, are provided in the rotating shaft sections 12 and 16. Therefore, the first white key unit 8, the second white key unit 9, and the black key unit 10 can be integrally connected without using the support shaft 40, unlike the structures of the second and third embodiments.

That is, in this keyboard instrument, the key bodies 11 and 15 of the first white key unit 8 and the second white key unit 9 are arranged between the key bodies 19 of the black key unit 10 and, in this state, the protruding shafts 45 provided in the rotating shaft sections 20 of the black key unit 10 are relatively inserted into the shaft holes 12*a* and 16*a* from the respective notched sections 12*b* and 16*b* of the rotating shaft sections 12 and 16 of the first white key unit 8 and the second white key unit 9. Accordingly, the first white key unit 8, the second white key unit 9, and the black key unit 10 can be integrally connected without using the support shaft 40.

Therefore, in this keyboard instrument, the first white key unit 8, the second white key unit 9, and the black key unit 10 can be easily attached. In addition, the first white key unit 8, the second white key unit 9, and the black key unit 10 can be easily mounted to the keyboard chassis 3 at once, without the key bodies 11, 15, and 19 becoming separated for each of the first white key unit 8, the second white key unit 9, and the black key unit 10, as in the cases of the second and third embodiments.

As described above, in the fourth embodiment, the protruding shafts 45 are individually formed on the respective end surfaces of the rotating shaft sections 20 of the black key unit 10. However, the protruding shafts 45 are not necessarily required to be individually formed, and a structure may be adopted in which the protruding shafts 45 are sequentially and integrally formed on the end surfaces of the rotating shaft sections 20.

As a result, the respective rotating shaft sections 12 and 16 of the first white key unit 8 and the second white key unit 9 can be reliably and firmly held by the protruding shafts 45, whereby the first white key unit 8, the second white key unit 9, and the black key unit 10 can be connected and integrated unfailingly.

While the prose invention has been described with reference to the preferred embodiments, it is intended that the invention be not limited by any of the details of the description therein but includes all the embodiments which fall within the scope of the appended claims.

What is claimed is:

1. A key structure comprising:

a plurality of key bodies which are arrayed in parallel;

a plurality of rotating shaft sections which are respectively provided in rear end portions of the plurality of key bodies and serve as fulcrums for rotations of the plurality of key bodies in an up and down direction; and a connecting section which rotatably connects the plurality of rotating shaft sections along an array direction of the key bodies.

2. The key structure according to claim 1, wherein the connecting section is provided with a plurality of bendable sections which are respectively connected to the plurality of rotating shaft sections and bendable in the up and down direction.

3. The key structure according to claim 1, wherein each of the plurality of rotating shaft sections is provided with a shaft hole passing through in the array direction of the key bodies, and wherein a support shaft which supports the plurality of rotating shaft sections so as to be rotatable in the up and down direction is inserted into the shaft holes.

4. The key structure according to claim 3, wherein each of the plurality of rotating shaft sections is provided with a notched section from which the supporting shaft is inserted into the shaft hole.

5. The key structure according to claim 1, further comprising:

a first key unit in which first key bodies each having a first rotating shaft section are connected by a first connecting section at a predetermined interval; and a second key unit in which second key bodies each having a second rotating shaft section are connected by a second connecting section so as to be positioned between the first key bodies;

wherein the first connecting section and the second connecting section overlap when the second key bodies are arranged between the first key bodies.

6. The key structure according to claim 5, wherein (a) one rotating shaft section among the first rotating shaft section and the second rotating shaft section is provided with a protruding shaft which protrudes in the array direction of the key bodies from an end surface of the one rotating shaft section, and (b) an other rotating shaft section among the first rotating shaft section and the second rotating shaft section is provided with (i) a shaft hole passing through in the array direction of the key bodies, into which the protruding shaft is inserted, and (ii) a notched section from which the protruding shaft is inserted into the shaft hole.

7. A keyboard instrument comprising:

a keyboard chassis;

a plurality of key bodies which are arrayed in parallel on the keyboard chassis;

a plurality of rotating shaft sections which are respectively provided in rear end portions of the plurality of key bodies and serve as fulcrums for rotations of the plurality of key bodies in an up and down direction;

a connecting section which connects the plurality of rotating shaft sections along an array direction of the key bodies by bendable sections which are bendable in the up and down direction; and a key supporting section which is provided on the keyboard chassis and holds the plurality of rotating shaft sections so as to be rotatable in the up and down direction.

8. The keyboard instrument according to claim 7, wherein the key supporting section comprises a plurality of bearing sections which rotatably hold the plurality of rotating shaft sections, respectively.

9. The keyboard instrument according to claim 7, wherein (a) the plurality of rotating shaft sections are each provided with a shaft hole passing through in the array direction of the key bodies, and (b) the key supporting section includes (i) a supporting shaft which is inserted into each shaft hole of the plurality of rotating shaft sections sequentially, and (ii) a shaft supporting section which supports the supporting shaft.

* * * * *